US005492277A

United States Patent [19]

Tani et al.

[11] Patent Number: 5,492,277

[45] Date of Patent: Feb. 20, 1996

[54] FLUID INJECTION NOZZLE

[75] Inventors: Yasuhide Tani, Nagoya; Hideto Inagaki, Aichi, both of Japan

[73] Assignee: Nippondenso Co., Ltd., Japan

[21] Appl. No.: 197,343

[22] Filed: Feb. 16, 1994

[30] Foreign Application Priority Data

Feb. 17, 1993 [JP] Japan ..... 5-028106
Apr. 28, 1993 [JP] Japan ..... 5-102114

[51] Int. Cl.[6] ..... B05B 1/04; B05B 1/14; F02M 61/16

[52] U.S. Cl. ..... 239/585.5; 239/590.5; 239/596; 239/601

[58] Field of Search ..... 239/533.12, 585.4, 239/585.5, 590.3, 590.5, 596, 601

[56] References Cited

U.S. PATENT DOCUMENTS

| | | | |
|---|---|---|---|
| 2,273,830 | 2/1942 | Brierly | 239/494 X |
| 2,563,152 | 8/1951 | Brandt | 239/596 |
| 3,529,774 | 9/1970 | Apri | 239/596 X |
| 3,647,147 | 3/1972 | Cook | 239/601 X |
| 3,921,916 | 11/1975 | Bassous | 239/601 |
| 4,013,229 | 3/1977 | Rohs | 239/493 |
| 4,066,491 | 1/1978 | Ruh et al. | 239/601 X |
| 4,455,192 | 6/1984 | Tamai | 156/628 |
| 4,607,794 | 8/1986 | Horwood | 239/596 X |
| 4,628,576 | 12/1986 | Giachino et al. | 239/533.12 X |
| 4,646,974 | 3/1987 | Sofianek et al. | 239/533.12 X |
| 4,647,013 | 3/1987 | Giachino et al. | 239/102.2 X |
| 4,733,823 | 3/1988 | Waggener et al. | 239/601 |
| 4,756,508 | 7/1988 | Giachino et al. | 239/494 X |
| 4,768,751 | 9/1988 | Giachino et al. | 239/102.1 X |
| 4,808,260 | 2/1989 | Sickafus et al. | 156/644 |
| 4,828,184 | 5/1989 | Gardner et al. | 239/590.3 |
| 4,890,794 | 1/1990 | Imafuku et al. | 239/533.12 |
| 4,907,748 | 3/1990 | Gardner et al. | 239/601 X |
| 4,971,254 | 11/1990 | Daly et al. | 239/533.12 X |
| 5,012,983 | 5/1991 | Buchholz et al. | 239/590.5 |
| 5,220,900 | 6/1993 | Wakeman | 239/405 X |
| 5,244,154 | 9/1993 | Buchholz et al. | 239/590.3 |
| 5,285,970 | 2/1994 | Maier et al. | 239/585.4 X |
| 5,323,966 | 6/1994 | Buchholz et al. | 239/585.4 X |

FOREIGN PATENT DOCUMENTS

| | | | |
|---|---|---|---|
| 0498931 | 11/1991 | European Pat. Off. . | |
| 0476298 | 1/1992 | European Pat. Off. . | |
| 0503757 | 9/1992 | European Pat. Off. . | |
| 2357508 | 6/1974 | Germany . | |
| 4104019 | 4/1992 | Germany . | |
| 683201 | 2/1965 | Italy | 239/601 |
| 61-104156 | 5/1986 | Japan . | |
| 68628 | 2/1994 | Japan . | |
| 1199272 | 12/1985 | U.S.S.R. | 239/601 |

OTHER PUBLICATIONS

"A study on Impingement Nozzles for Diesel Engines" by Yasusi Tanasawa et al.

*Primary Examiner*—Andres Kashnikow
*Assistant Examiner*—Lesley D. Morris
*Attorney, Agent, or Firm*—Cushman Darby & Cushman

[57] ABSTRACT

A fluid injection nozzle according to the present invention comprises a first plate having a first hole through which fluid is allowed to flow in, a second plate disposed in layers on the downstream side of the first plate and having a second hole partially communicating with said first hole and tapered toward the downstream side, and a space which is formed between an outlet of the first hole and an outlet of the second hole and in which a liquid film is formed by the fluid which collides with an inner wall surface serving to form the second hole.

37 Claims, 22 Drawing Sheets

FLUID INJECTION NOZZLE

BACKGROUND OF THE INVENTION

The present invention relates to a fluid injection nozzle and, more specifically, to an injection nozzle section of an electromagnetic fuel injection valve that delivers fuel by injection to an internal combustion engine of an automobile.

Generally, in the fuel injection nozzle to be used in the internal combustion engine, a valve member is slidably received in a guide hole formed axially in a valve main body and an injection hole opened in a tip end portion of the valve main body is opened and closed by the vertical movement of the valve member. For this reason, the valve member is controlled accurately in its lift in opening the valve for the purpose of obtaining an appropriate fuel injection amount.

Examples of the prior art include a fluid injection nozzle disclosed in Japanese Patent Unexamined Publication No. 61-104156 in which a large number of slit-like orifices are provided in front of the injection hole so that, by making fuel coming from the injection hole pass through the slit-like orifices, it is possible to obtain a spray of fuel atomized and dispersed through over a wide angle.

Further, U.S. Pat. No. 4,907,748 discloses the one in which a plurality of silicon plates are provided in front of the injection hole. An accurate fuel path hole pattern can be formed by making use of the silicon plates, and accordingly, the fuel flow can be controlled.

Moreover, U.S. Pat. No. 4,647,013 discloses a fluid injection nozzle in which a silicon flat plate having an orifice for controlling the fuel flow is provided in front of the injection hole.

As disclosed in Japanese Patent Unexamined Publication No. 61-104156 described above, in order to promote the atomization of the spray of fuel, various shapes of injection holes have been proposed heretofore.

However, with the shapes of injection holes disclosed in the prior arts, it has been difficult to atomize the fuel sufficiently.

SUMMARY OF THE INVENTION

An object of the present invention is to atomize injection fluid into fine particles with a simple construction.

Another object of the present invention is not only to atomize the injection fluid into fine particles with simple construction but also to limit a spray angle of the injection fluid properly.

Still another object of the present invention is to form a desired fluid path configuration with a simple construction.

A further object of the present invention is to add, with a simple construction, a space expanding radially with respect to a fluid path communicating directly from upstream side toward downstream side.

A still further object of the present invention is to add, with a simple construction, a groove extending radially with respect to a fluid path communicating directly from upstream side toward downstream side.

In order to achieve this end, according to an aspect of the present invention, there is provided a fluid injection nozzle which comprises a first plate having a slit-like first hole through which a fluid is allowed to flow in and a second plate underlying on the downstream side of the first plate and having a second hole partially communicating with the first hole.

In accordance with the above construction of the invention, the fluid is injected after being passed through the first hole and, further, through the second hole. Since the first hole is formed in a slit-like shape and partially communicates with the second hole, the first hole appears substantially as groove except a portion thereof communicating with the second hole. Accordingly, the fluid generates such flows that move along the slit-like first hole toward the second hole. And, the flows thus moving along the slit-like first hole collide with each other when they move into the second hole, so that the direction of the flow is changed, thereby promoting the atomization of the fluid injected.

According to another aspect of the present invention, there is provided a fluid injection nozzle which comprises a first plate having a first hole through which a fluid is allowed to flow in, a second plate underlying on the downstream side of the first plate and having a second hole which partially communicates with the first hole and is tapered toward the downstream side, and a space formed between an outlet of the first hole and an outlet of the second hole and serving to form a liquid film by the fluid colliding with an inner wall surface by which the second hole is formed.

In accordance with the above construction of the invention, the fluid is injected after being passed through the first hole and, further, through the second hole. Part of the fluid passed through the outlet of the first hole collides with the inner wall surface forming the second hole. Then, a thin liquid film is formed on the inner wall surface within the space formed between the outlet of the first hole and the outlet of the second hole. Accordingly, the flow becomes unstable owing to the collision with the fluid resulting from the thin liquid film, thereby promoting the atomization of the fluid injected from the second hole.

DESCRIPTION OF THE PREFERRED EMBODIMENTS

Description will be given below of preferred embodiments of the present invention with reference to the drawings.

A fluid injection nozzle according to a first embodiment of the present invention is shown in FIGS. 1 to 5.

In this embodiment, the fluid injection nozzle according to the present invention is applied to a fuel injection valve of a fuel feed system of a gasoline engine.

Figure 2:
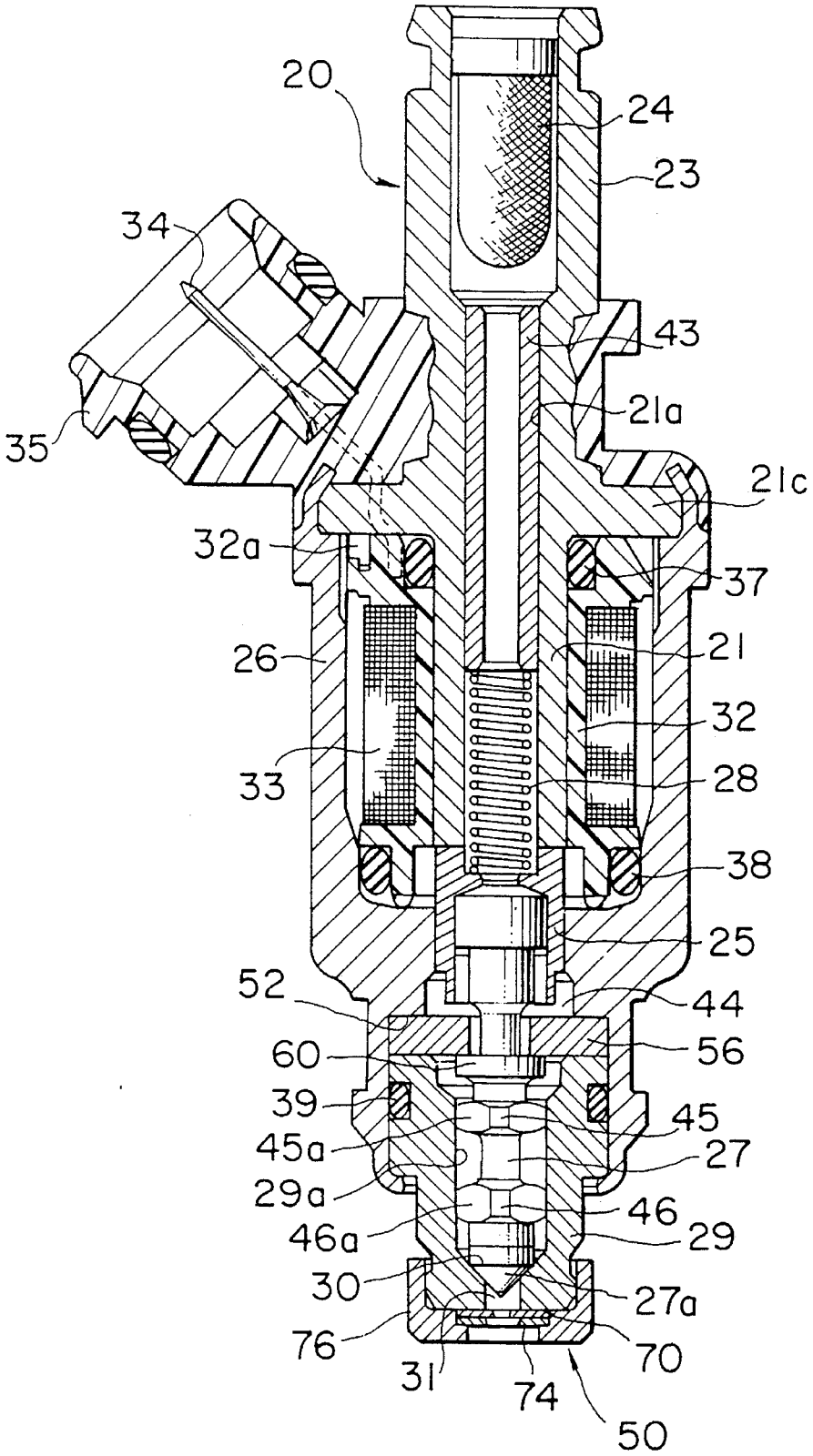
FIG. 2 is a sectional view of the first embodiment of a fuel injection apparatus according to the present invention.

As shown in FIG. 2, a fuel injection valve 20 comprises a housing 26 which is made of a magnetic material and in which a fixed iron core 21, a movable iron core 25, a valve member 27 and a valve main body 29 are fixed in the axial direction. The movable iron core 25 and the valve member 27 which are movable in the axial direction are biased in a valve closing direction by means of a compression coil spring 28 received in the fixed iron core 21 so that a valve head 27*a* formed at an end of the valve member 27 comes into contact with a valve seat 30 of the valve main body 29.

Around the fixed iron core 21 is provided an electromagnetic coil 33. The electromagnetic coil 33 is wound on a spool 32 fixed on the outer peripheral surface of the fixed iron core 21. A terminal 34 electrically connected to the electromagnetic coil 33 is embedded in a connector 35 and an extended portion 32*a* of the spool 32 which are made of synthetic resin. A flange portion 2l*c* of the fixed iron core 21 is formed therein with a hole through which the terminal 34 is led out toward the connector 35. And, as an electric signal for injection control is sent from an electronic control unit which is not shown to the terminal 34 through a wire harness, an exciting current is passed through the electromagnetic coil 33, so that, owing to an attractive force generated in the fixed iron core 21, the movable iron core 25 and the valve member 27 are caused to move in a valve opening direction against a biasing force of the compression coil spring 28.

Fuel fed under pressure from a fuel tank by means of a pump is introduced into the fuel injection valve 20 through a connector pipe 23 formed integrally with the fixed iron core 21. The connector pipe 23 is formed at an end portion of the fixed iron core 21 opposite to the movable iron core 25, and a filter 24 serving to remove foreign matters contained in the fuel is fixed within the connector pipe 23.

The fixed iron core 21 is formed therein with a through hole 21*a* in the axial direction. In the through hole 21*a* is inserted a guide pipe 43 which serves to guide the fuel in the connector pipe 23 toward the movable iron core 25. The guide pipe 43 supports the compression coil spring 28 by an end portion thereof opposite to the connector pipe 23. For this reason, the biasing force of the compression coil spring 28 is adjusted by changing the position at which the guide pipe 43 is fixed in the axial direction within the through hole 21*a*.

The valve member 27 is formed on the outer peripheral surface thereof with guide portions 45 and 46 which are spaced from each other by a predetermined distance and allowed to slide on an inner peripheral surface 29*a* of the valve main body 29, and the guide portions 45 and 46 have four chambered grooves 45*a* and 46*a* formed therein, respectively. The fuel passing through the guide pipe 43 is made to pass through the movable iron core 25 and flow into a hollow portion 44 from which the fuel is made to further pass through the grooves 45*a* and 46*a* to reach an injection hole 31.

An O ring 37 is disposed between the fixed iron core 21 and the spool 32, while another O ring 38 is disposed between the spool 32 and the housing 26. Further, still another O ring 39 is disposed between the valve main body 29 and the housing 26. These O rings 37, 38 and 39 serve to prevent the fuel introduced into the fuel injection valve 20 from flowing out to the outside.

Next, construction of a discharge portion 50 of the fuel injection valve 20 will be described.

As shown in FIG. 2, in a circular concave portion 52 formed in the housing 26 and communicating with the hollow portion 44, the valve main body 29 and an annular stopper 56 are inserted and are fixed therein by caulking the housing 26. In a guide hole 29*a* of the valve main body 29, the valve member 27 is receiprocatingly inserted. The annular stopper 56 has an outer diameter which is smaller than an inner diameter of the concave portion 52 and has an inner diameter which is smaller than an outer diameter of a flange portion 60. The thickness of the stopper 56 is so adjusted as to maintain an air gap between the fixed iron core 21 and the movable iron core 25 at a predetermined value.

When the valve is opened, the valve member 27 is moved in the valve opening direction to a position where the flange portion 60 is brought into contact with the stopper 56. At this time, the fuel in the hollow portion 44 is allowed to pass through the stopper 56 and the guide hole 29 so as to be injected through the injection hole 31.

When the valve is closed, the valve head 27*a* of the valve member 27 comes into contact with the valve seat 30. For this reason, a fuel passage connecting between the guide hole 29*a* and the injection hole 31 is cut off, so that the injection of the fuel is suspended.

Figure 1:
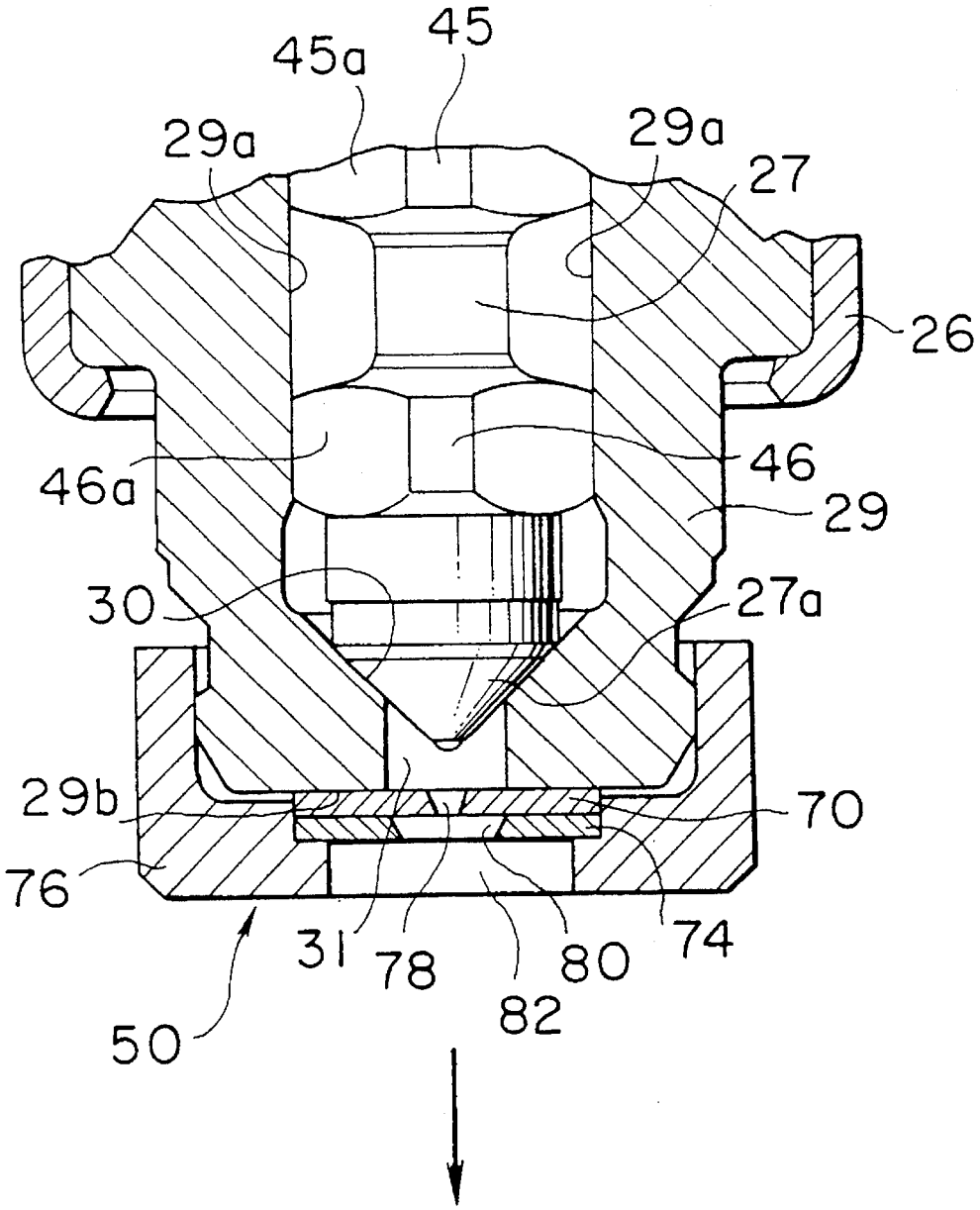
FIG. 1 is a sectional view of a first embodiment of a fuel injection valve according to the present invention, showing an injection hole and therearound.

And, as shown in FIG. 1, a first orifice plate 70 is put on in front of the end of the injection hole 31 of the valve main body 29, and a second orifice plate 74 underlies the lower surface of the first orifice plate 70, and a sleeve 76 which serves to fix these first and second orifice plates 70 and 74 to an end face 29*b* of the valve main body 29 is fixed by caulking to the valve main body 29.

Figure 3A:
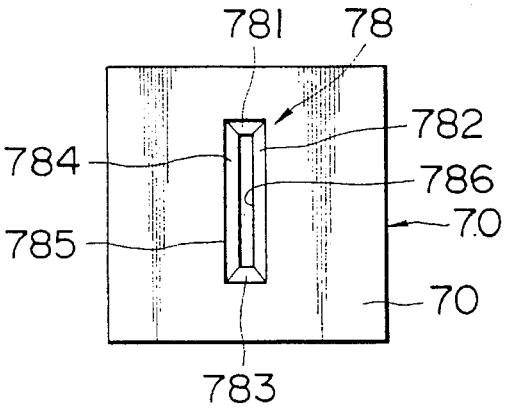
FIG. 3A is a plan view of a first orifice plate according to the first embodiment of the present invention.
Figure 4A:
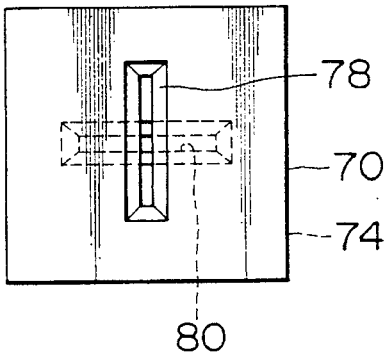
FIG. 4A is a plan view showing a state in which the first and second orifice plates according to the first embodiment of the present invention are overlapped each other.
Figure 4B:
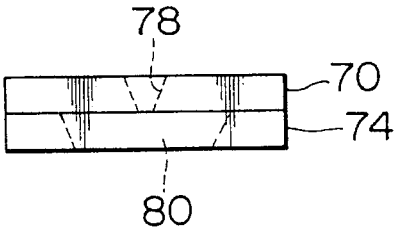
FIG. 4B is a side view of the state.

The first orifice plate 70 is made of silicon and, as shown in FIG. 3A, a slit-like first orifice 78 is formed in the central portion thereof. The first orifice 78 has an elongated linear form and is tapered as going downstream along the flow of fuel (FIG. 4B).

The first orifice 78 is surrounded by a polyhedral wall surface obtained by etching a silicon single crystal plate. The wall surface has a pair of inclined surfaces 781 and 783 which are opposite to each other and inclined so as to gradually approach each other as going toward the downstream side and another similar pair of inclined surfaces 782 and 784. And, a downstream-side opening 786 is formed to be smaller in size than an upstream-side opening 785.

Figure 3B:
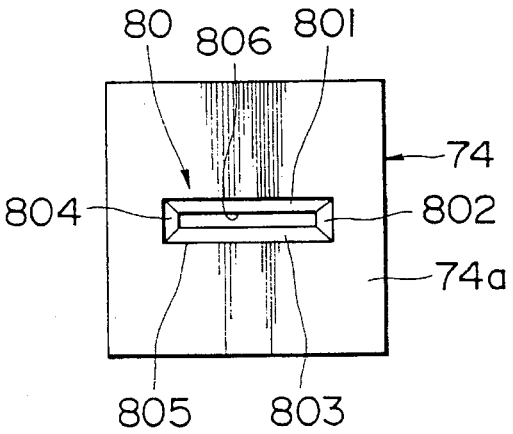
FIG. 3B is a plan view of a second orifice plate according to the first embodiment of the present invention.

The second orifice plate 74 is formed therein with a slit-like second orifice 80 which is made to intersect at right angles to the first orifice 78, as shown in FIG. 3B. The second orifice 80 is tapered as going downward like the first orifice 78.

The second orifice 80 is surrounded by a polyhedral wall surface obtained by etching a silicon single crystal plate. The wall surface has a pair of inclined surfaces 801 and 803 which are opposite to each other and inclined so as to gradually approach each other as going toward the downstream side and another similar pair of inclined surfaces 802 and 804. And, a downstream-side opening 806 is formed to be smaller in size than an upstream-side opening 805. As shown in FIGS. 4A and 4B, when attached to the valve main body 29, the first and second orifice plates 70 and 74 are overlapped each other so that the first and second orifices 78 and 80 are made to intersect perpendicularly to each other.

Figure 5:
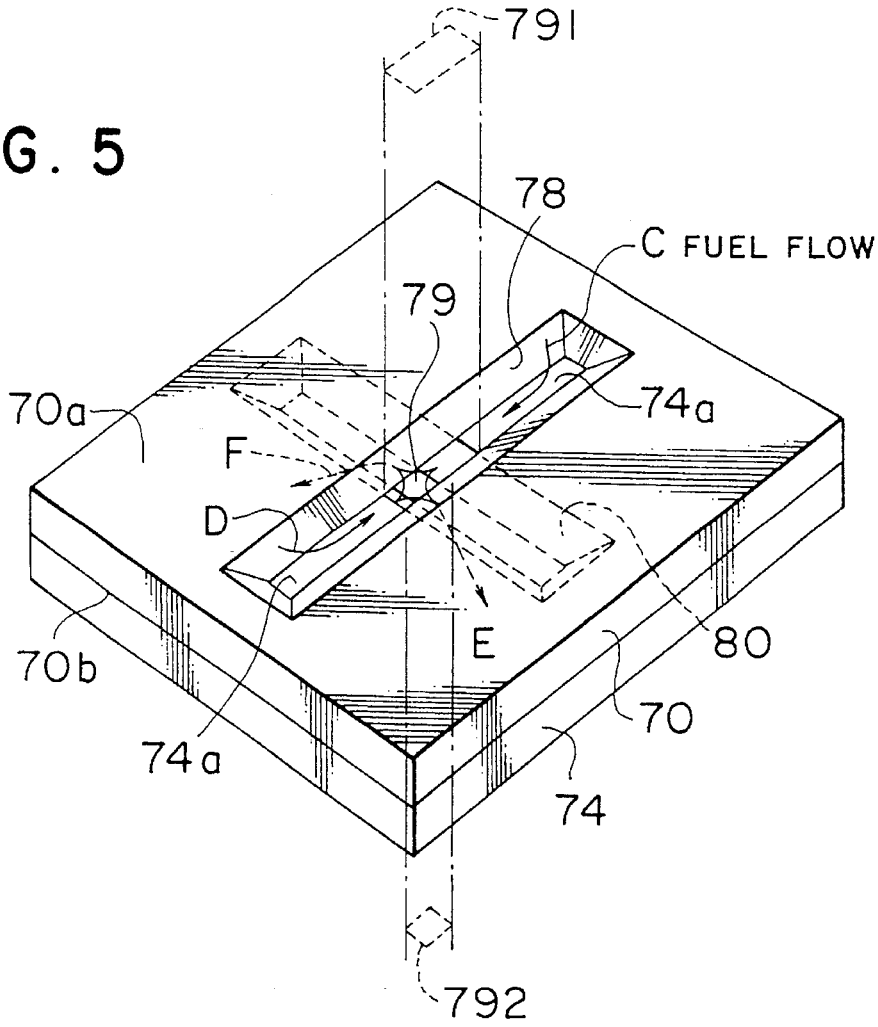
FIG. 5 is a perspective view for explanation of a state of fuel flow according to the first embodiment of the present invention, showing the first and second orifice plates.

Accordingly, as shown in FIG. 5, a flow path 79 leading from the first orifice 78 and passing through the second orifice 80 can be formed.

It is noted here that the downstream-side opening 786 of the first orifice 78 is directly communicated with the second orifice 80 only at a portion located substantially in the center thereof, and this communication opening 791 has a rectangular form as shown in FIG. 5. Further, the other portion of the downstream-side opening 786 of the first orifice 78 is closed by an upper surface 74*a* of the second orifice plate 74. In consequence, the first orifice 78 forms two grooves which extend from opposite two directions to the communication opening 791.

On the other hand, the upstream-side opening 805 of the second orifice 80 is directly communicated with the first orifice 78 through the communication opening 791 only at a portion located substantially in the center thereof. And, the other portion of the upstream-side opening 805 of the second orifice 80 is closed by a lower surface 70*b* of the first orifice plate 70, and the second orifice 80 forms two grooves which extend from the communication opening 791 in opposite directions. In consequence, the flow path 79 passing through the first and second orifices 78 and 80 has such a shape that expands in the longitudinal direction of the second orifice 80 just after the communication opening 791. Besides, a pair of inclined surfaces 801 and 803 of the second orifice 80 are inclined so as to gradually approach each other as going toward the downstream side, and accordingly, the opening area in which both orifices are directly communicated with each other when viewed from the downstream side toward the upstream side in the direction of fuel injection, is far smaller than those of the both the orifices 78 and 80 as shown as a penetrating opening 792 in FIG. 5.

The fuel infection hole formed as described above serves to constitute a measuring hole which measures an amount of injection fuel.

The fuel injection characteristic obtained by The orifice shape formed by overlapping the first and second orifice plates 70 and 74 will be described with reference to FIG. 5.

When the valve member 27 is lifted from the vale seat 30 of the valve main body 29, fuel is injected through the injection hole 31. The fuel injected through the injection hole 31 is passed through the first and second orifices 78 and 80 so as to be injected and supplied downward. In this case, part of the fuel passing through the first orifice 78 flows toward the communication opening 791 using the grooves formed by the first orifice 78 and the upper surface 74*a* as a runway as shown by solid-line arrow marks C and D in FIG. 5. The flows C and D coming through the both runways collide with each other at the center to change their courses so that they are made to pass through the second orifice 80 while spreading out in a fan-like shape as shown by dotted line arrow marks E and F. It is noted here that the fuel blown through the communication opening 791 is regulated in apreading direction thereof by the inner wall surface forming the second orifice 80. In this embodiment, the fuel flows coming through the first orifice 78 serving as the runway collide with each other and are atomized and spread along a spray guide path formed by the second orifice 80. Moreover, in this embodiment, since the groove-like runway is formed by the first orifice 78 and the upper surface 74*a* of the second orifice plate 74, an excellent atomized spray can be obtained with a simple structure that the two plates are each formed therein only with the slit-like orifice.

According to the first embodiment, the fuel injected from the injection hole 31 is passed through the first and second orifices 78 and 80 so as to be further injected. This injection fuel is passed through the first orifice 78 which is tapered and, then, further passed through the second orifice 80 which is tapered, and accordingly, it is possible to atomize the injection fuel so as to form a spray of fuel that has a small spray angle in one direction and a good spray characteristic. In consequence, the fuel supplied through an intake port which is not shown to a combustion chamber of an internal combustion engine is not only easy to burn but also hardly adheres to the intake port.

Next, description will be given of a modification shown in FIG. 6 in which the first and second orifice plates 70 and 74 according to the first embodiment are used.

Figure 6:
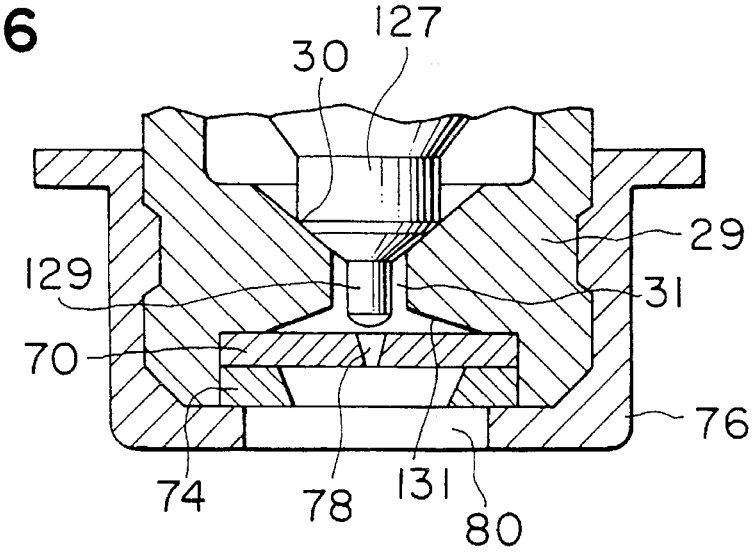
FIG. 6 is a sectional view of a modification of the first embodiment of the present invention, showing the injection hole and therearound.

In the modification shown in FIG. 6, the present invention is applied to a pintle type fuel injection valve. A needle 127 is formed at the tip end portion thereof with a projective pintle 129. FIG. 6 shows a state in which the needle 127 is seated on the valve seat 30 of the valve main body 29. In the front of the injection hole 31 is formed a concave portion 131 which is larger than the injection hole 31. The first and second orifice plates 70 and 74 are fitted within the concave portion 131 formed in the valve main body 29. The sleeve 76 is brought into contact with the lower surface of the second orifice plate 74, and the sleeve 76 is press-fitted and fixed on the outer periphery of the valve main body 29. In the modification of the first embodiment shown in FIG. 6, the atomization characteristic and, further, the spray angle characteristic of the spray of fuel become the good ones similarly to the first embodiment and, at the same time, the accuracy of positioning of the first and second orifice plates 70 and 74 which are fitted in the concave portion 131 can be improved.

Next, description will be given of a second embodiment of the present invention shown in FIGS. 7A, 7B, 8A and 8B.

Figure 7A:
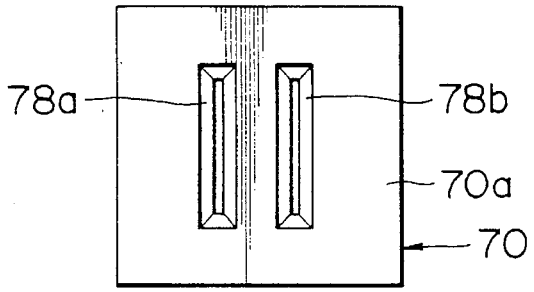
FIG. 7A is a plan view of a first orifice plate according to a second embodiment of the present invention.
Figure 7B:
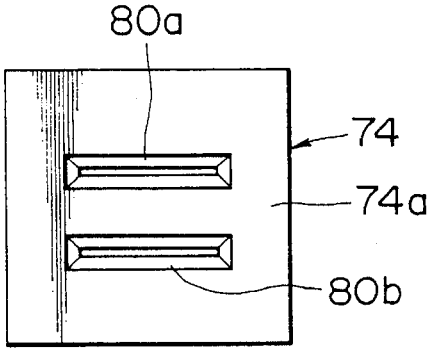
FIG. 7B is a plan view of a second orifice plate according to the second embodiment of the present invention.

The second embodiment shown in FIGS. 7A and 7B comprises a pair of slit-like first orifices 78*a*, 78*b* and another pair of slit-like second orifices 80*a*, 80*b*. The pair of first orifices 78*a* and 78*b* are formed in parallel with each other. The second orifices 80*a* and 80*b* are formed to intersect perpendicularly to these first orifices 78*a* and 78*b*. Both the first orifices 78*a*, 78*b* and the second orifices 80*a*, 80*b* are so formed as to be tapered toward the downstream side in the flowing direction of the fuel.

Figure 8A:
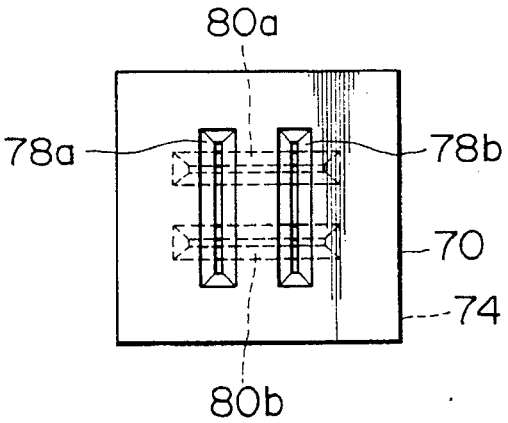
FIG. 8A is a plan view showing a state in which the first and second orifice plates according to the second embodiment of the present invention are overlapped each other.
Figure 8B:
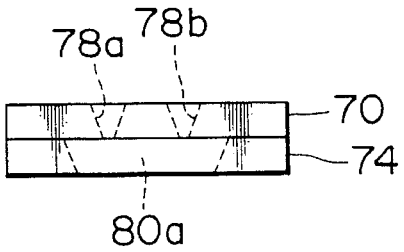
FIG. 8B is a side view of the state.
Figure 9A:
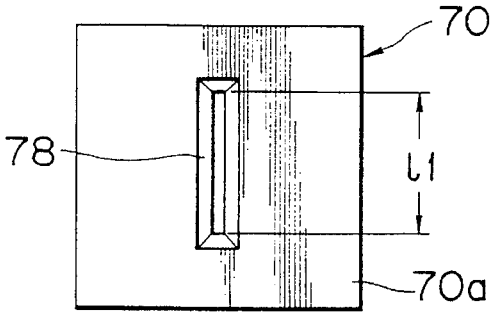
FIG. 9A is a plan view of a first orifice plate according to a third embodiment of the present invention.

As shown in FIGS. 8A and 8B, in a state in which the first and second orifice plates 70 and 74 are overlapped each other, there are formed four penetrating openings at the positions where the first orifices 78*a*, 78*b* and the second orifices 80*a*, 80*b* are overlapped each other, extending through them from top to bottom. According to the second embodiment shown in FIGS. 7A, 7B, 8A and 8B, owing to the first orifices 78*a*, 78*b* and the second orifices 80*a*, 80*b*, it is possible to obtain a spray of fuel having a good atomization characteristic similarly to the first embodiment.

Next, description will be given of a third embodiment of the present invention shown in FIGS. 9A, 9B, 10A and 10B.

In the third embodiment, the upper first orifice plate 70 is formed therein with the first orifice 78 which is straight and tapered toward downward, similarly to the first orifice plate of the first embodiment. The longitudinal-length of a slit of the first orifice 78 is $1_1$. The second orifice plate 74 is formed therein with two second orifices 80*c* and 80*d* which are each square-shaped and tapered toward downward. The length between the centers of these two second orifices 80*c* and 80*d* is set to be $1_2$ which is shorter than the length $1_1$ of the first orifice 78.

Figure 10A:
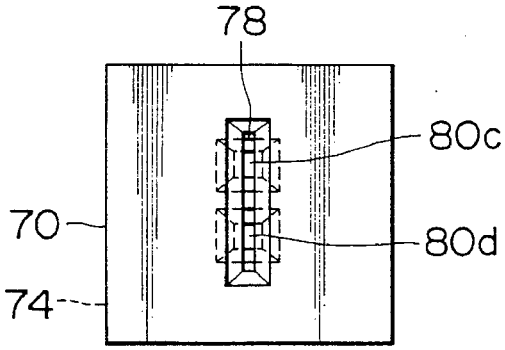
FIG. 10A is a plan view showing a state in which the first and second orifice plates according to the third embodiment of the present invention are overlapped each other.
Figure 9B:
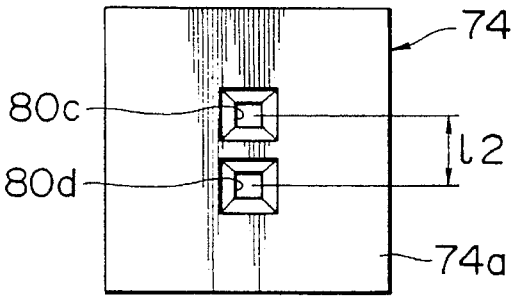
FIG. 9B is a plan view of a second orifice plate according to the third embodiment of the present invention.
Figure 10B:
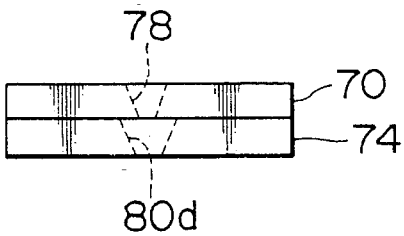
FIG. 10B is a side view of the state.

In a state in which the first and second orifice plates 70 and 74 are overlapped each other, the first orifice 78 and the second orifices 80*c*, 80*d* are so positioned as to be overlapped each other as shown in FIGS. 10A and 10B.

According to the third embodiment as well, it is possible to obtain a spray of fuel having a good fuel atomization characteristic.

Moreover, according to the third embodiment, the provision of the two second orifices makes it possible to obtain two sprays of the fuel in two directions. Further, with the structure of the third embodiment, it is possible to control the directions of the two-directional sprays by changing the distance $1_2$ between the second orifices.

Next, description will be given of a fourth embodiment of the present invention shown in FIGS. 11A and 11B.

Figure 11A:
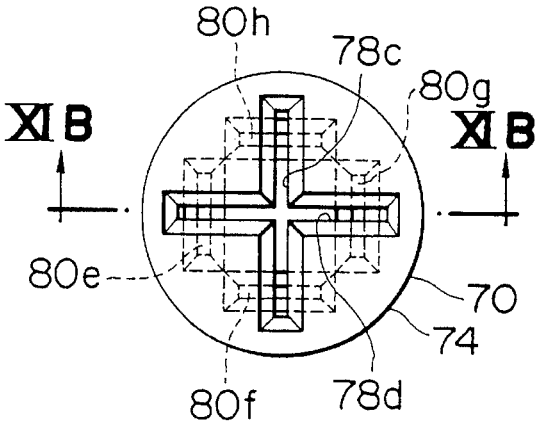
FIG. 11A is a plan view showing a state in which first and second orifice plates according to a fourth embodiment of the present invention are overlapped each other.
Figure 11B:
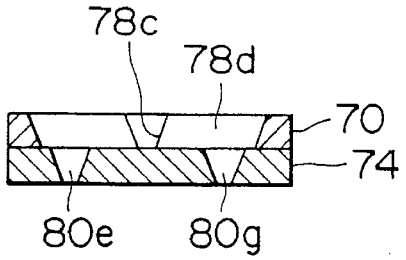
FIG. 11B is a sectional view taken along the line XIB—XIB of FIG. 11A

In the fourth embodiment shown in FIGS. 11A and 11B, the orifice plates 70 and 74 are formed in the shape of a circle. Further, first orifices 78*c* and 78*d* are arranged to meet at right angles with each other. While, second orifices 80*e*, 80*f*, 80*g* and 80*h* are formed separately from each other and arranged on the four sides of a square, respectively. The square defined by these second orifices 80*e*, 80*f*, 80*g* and 80*h* is formed to be of the size that makes them perpendicularly cross the four arm portions of the first orifices 78*c* and 78*d*, respectively. Both the first orifices 78*c*, 78*d* and the second orifices 80*e*, 80*f*, 80*g*, 80*h* are tapered toward downstream.

Figure 15A:
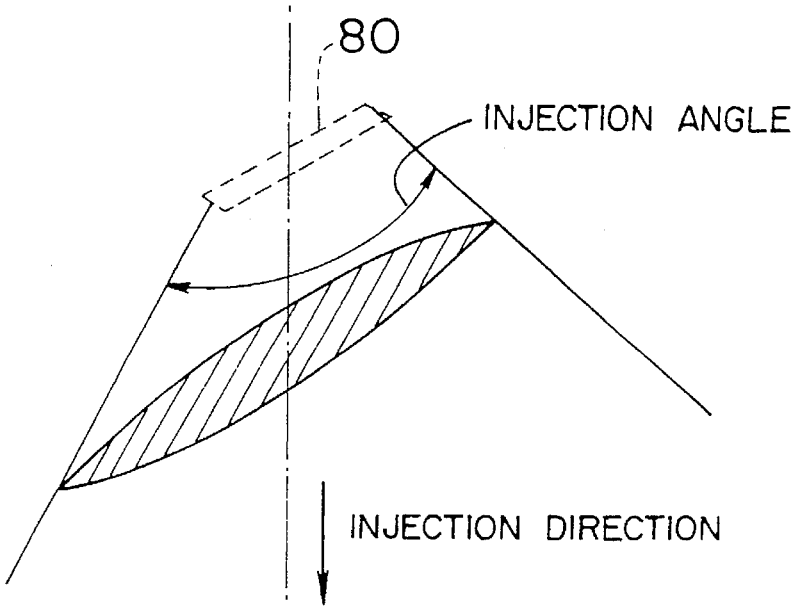
FIG. 15A is a schematic perspective view showing a spray form of fuel injected from the second orifice according to the first embodiment of the present invention.
Figure 15B:
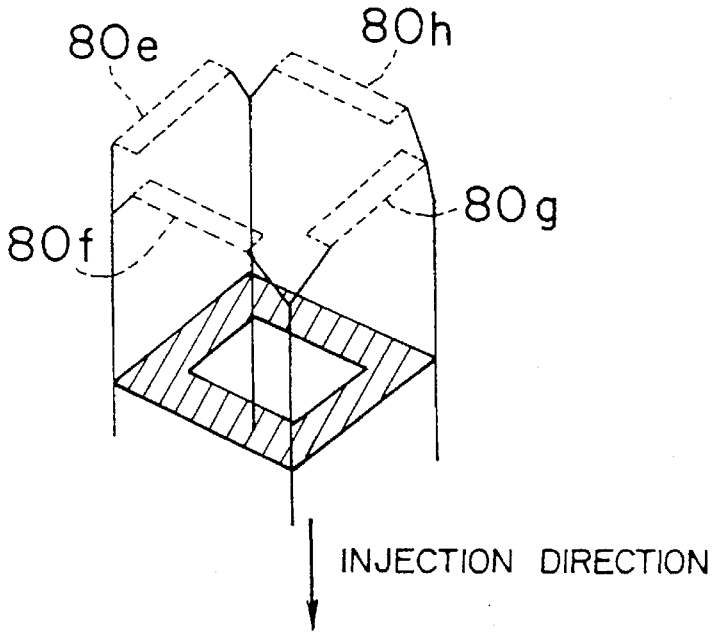
FIG. 15B is a schematic perspective view showing a spray form of fuel injected from the second orifice according to the fourth embodiment of the present invention.

According to the fourth embodiment, the shape of a spray of fuel is as shown in FIG. 15B.

According to the first embodiment, the shape of the spray of fuel injected through the second orifice 80 is a fan as shown in FIG. 15A. However, according to the fourth embodiment, since four fan-shaped sprays interfere with each other, a cylindrical spray is formed as shown in FIG. 15B. In consequence, the spray of fuel according to the fourth embodiment makes it possible to suppress the expansion of the spray cone angle because the liquid films interfere with each other as shown in FIG. 15B.

In the fourth embodiment as well, it is possible to obtain a good fuel spray characteristic likewise. Incidentally, FIGS. 15A and 15B schematically show the spray forms as viewed obliquely from above.

Next, description will be given of a fifth embodiment of the present invention shown in FIGS. 12A and 12B.

Figure 12A:
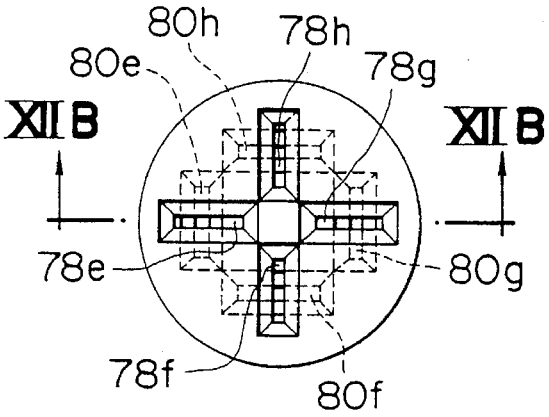
FIG. 12A is a plan view showing a state in which first and second orifice plates according to a fifth embodiment of the present invention are overlapped each other.
Figure 12B:
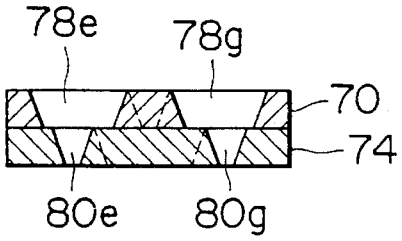
FIG. 12B is a sectional view taken along the line XIIB—XIIB of FIG. 12A.

In the fifth embodiment shown in FIGS. 12A and 12B, four first orifices 78*e*, 78*f*, 78*g* and 78*h* are formed separately from each other and arranged in the form of a cross. The four second orifices 80*e*, 80*f*, 80*g* and 80*h* are identical with the second orifices of the fourth embodiment shown in FIGS. 11A and 11B. Both the first orifices 78*e*, 78*f*, 78*g*, 78*h* and the second orifices 80*e*, 80*f*, 80*g*, 80*h* are tapered toward downstream. And, the first orifices 78*e*, 78*f*, 78*g*, 78*h* and the second orifices 80*e*, 80*f*, 80*g*, 80*h* are so arranged as to make four pairs of perpendicularly intersecting first and second orifices.

According to the fifth embodiment, it is possible to obtain a good fuel spray characteristic.

Next, description will be given of a sixth embodiment of the present invention shown in FIGS. 13A and 13B.

Figure 13A:
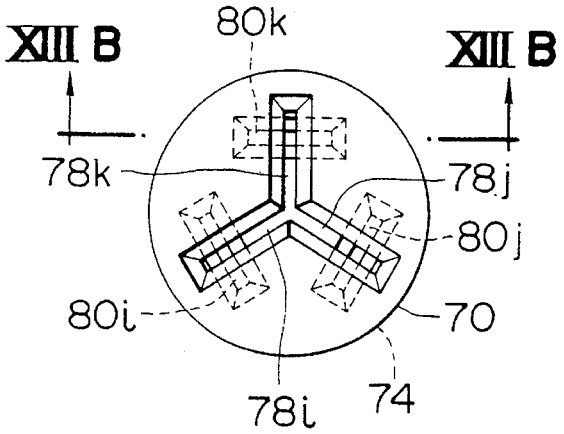
FIG. 13A is a plan view showing a state in which first and second orifice plates according to a sixth embodiment of the present invention are overlapped each other.
Figure 13B:
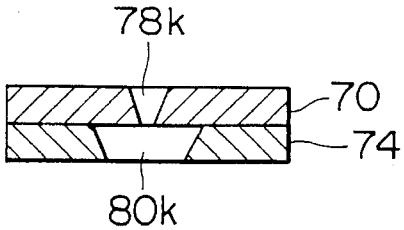
FIG. 13B is a sectional view taken along the line XIIIB—XIIIB of FIG. 13A.

In the sixth embodiment shown in FIGS. 13A and 13B, first orifices 78*i*, 78*j* and 78*k* are formed straight in the radial direction with angular intervals of 120° and are tapered toward downward. Second orifices 80*i*, 80*j* and 80*k* are tapered toward downstream and separated from each other so as to meet at right angles with the first orifices 78*i*, 78*j* and 78*k*, respectively.

Next, description will be given of a seventh embodiment of the present invention shown in FIGS. 14A and 14B.

Figure 14A:
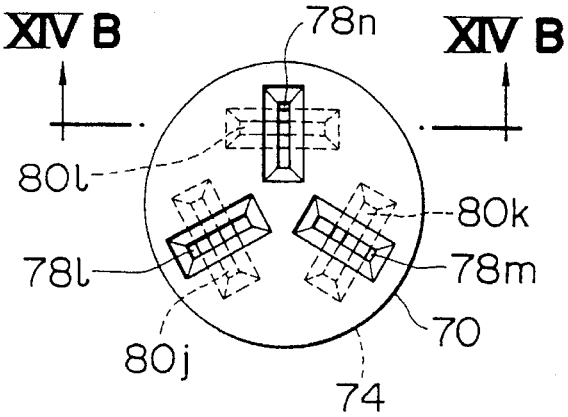
FIG. 14A is a plan view showing a state in which first and second orifice plates according to a seventh embodiment of the present invention are overlapped each other.
Figure 14B:
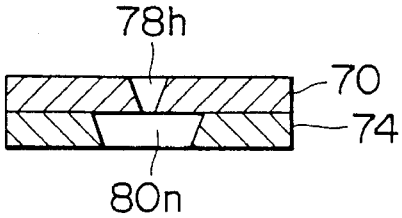
FIG. 14B is a sectional view taken along the line XIVB—XIVB of FIG. 14A.

In the seventh embodiment shown in FIGS. 14A and 14B, first orifices 78*l*, 78*m* and 78*n* are formed in the radial direction so as to be separated from each other and are tapered toward downward. Second orifices 80*l*, 80*m*, 80*n* are formed separately from each other so as to meet at right angles with the first orifices 78*l*, 78*m* and 78*n*, respectively. Both the first orifices 78*l*, 78*m*, 78*n* and the second orifices 80*l*, 80*m*, 80*n* are so formed as to be tapered from the upper surface toward the lower surface.

According to the fourth, fifth, sixth and seventh embodiments described above, it is possible to form a cylindrical spray by making the fan-shaped sprays interfere with each other.

Next, description will be given of eighth, ninth and tenth embodiments of the present invention shown in FIGS. 16A, 16B, 17A, 17B, 18A and 18B, respectively.

In each of these eighth, ninth and tenth embodiments, a slit-like first orifice and a slit-like second orifice which are so formed as to be tapered, divergent or straightened as viewed from top to bottom are employed in combination.

Figure 16A:
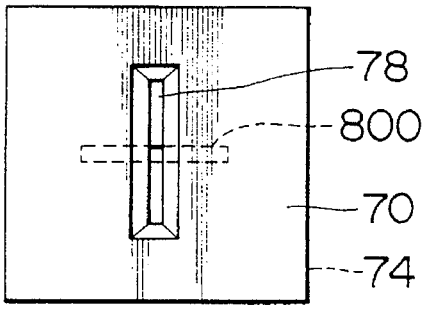
FIG. 16A is a plan view showing a state in which first and second orifice plates according to an eighth embodiment of the present invention are overlapped each other.
Figure 16B:
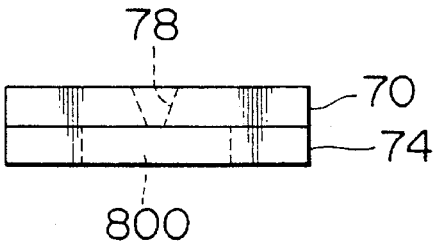
FIG. 16B is a side view of the state.

In the eighth embodiment shown in FIGS. 16A and 16B, the first orifice 78 and a second orifice 800 are made to intersect with each other. The second orifice 800 is formed in the second orifice plate 74 so as to be straightened as viewed from top to bottom.

According to the eighth embodiment as well, it is possible to obtain a good fuel spray characteristic likewise.

Figure 17A:
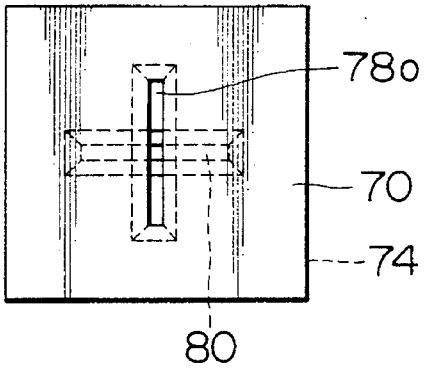
FIG. 17A is a plan view showing a state in which first and second orifice plates according to a ninth embodiment of the present invention are overlapped each other.
Figure 17B:
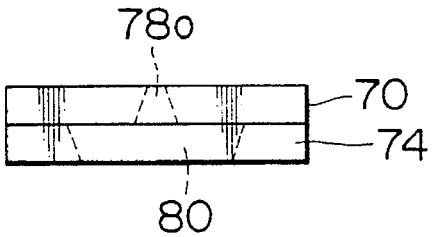
FIG. 17B is a side view of the state.

In the ninth embodiment shown in FIGS. 17A and 17B, a first orifice 780 is so formed as to be divergent as viewed from top to bottom. The second orifice 80 is so formed as to meet at right angles with the first orifice 780.

Figure 18A:
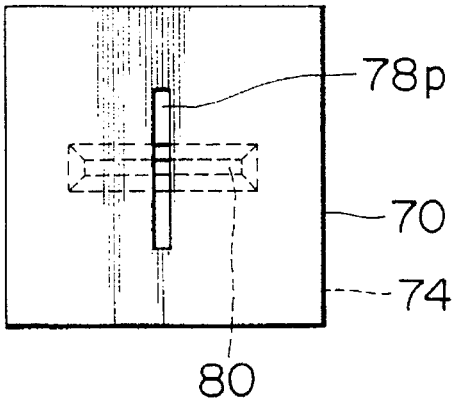
FIG. 18A is a plan view showing a state in which first and second orifice plates according to a tenth embodiment of the present invention are overlapped each other.
Figure 18B:
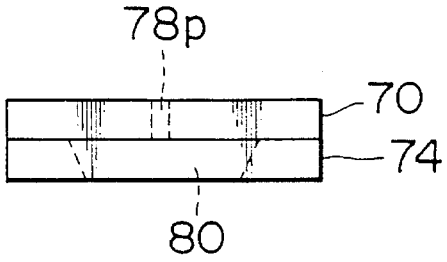
FIG. 18B is a side view of the state.
Figure 19A:
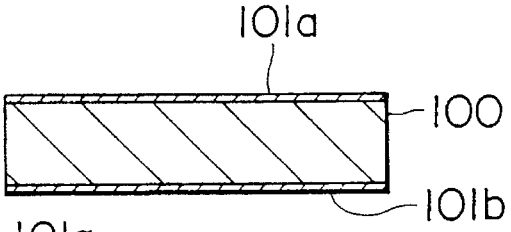
FIGS. 19A–E are process views showing another orifice plate producing method.
Figure 19B:
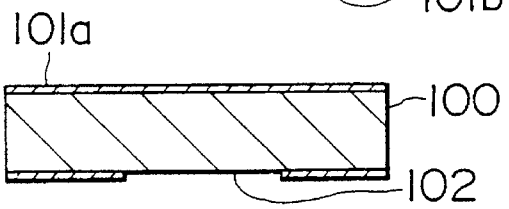
Figure 19C:
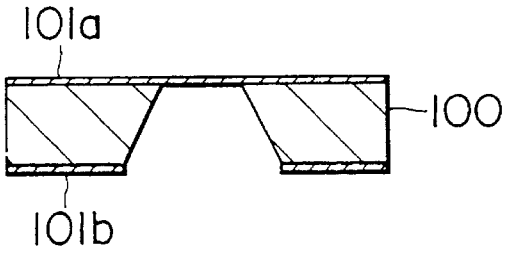
Figure 19D:
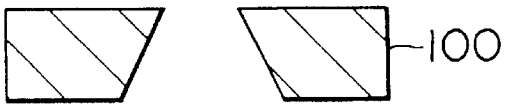
Figure 19E:
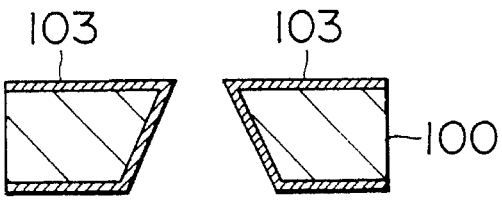
Figure 20A:
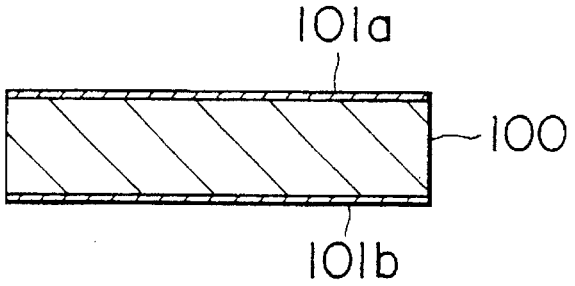
FIGS. 20A–G are precess views showing still another orifice plate producing method.
Figure 20B:
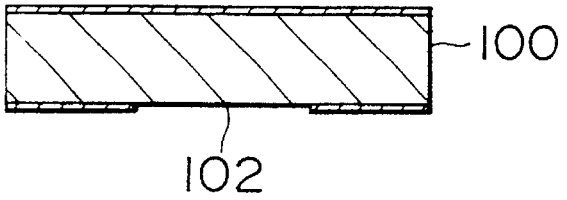
Figure 20C:
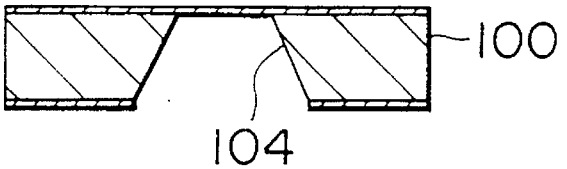
Figure 20D:
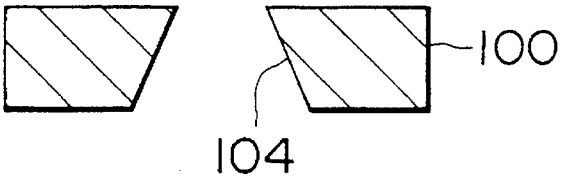
Figure 20E:
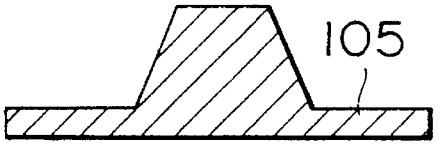
Figure 20F:
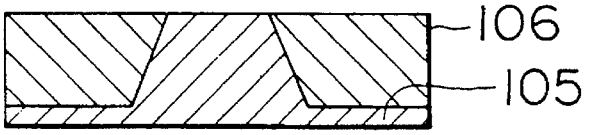
Figure 20G:
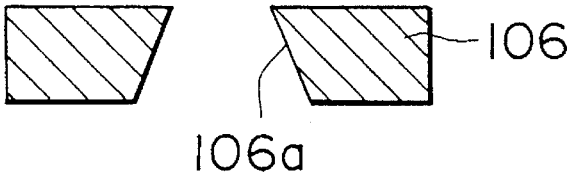

In the tenth embodiment shown in FIGS. 18A and 18B, a first orifice 78*p* is a straight slit which is so formed as to be straightened as viewed from top to bottom. The second orifice 80 is identical with the second orifice 80 of the first embodiment.

It is possible to obtain a good spray form as well even with the orifice plates 70 and 74 according to this tenth embodiment.

It is noted that the first and second orifices can have any combination of sectional forms including tapered, divergent and straightened forms, and it is possible to obtain both an atomization effect attained by using the grooves formed by the upstream-side orifice as the runway and a spray direction control effect produced by the downstream-side orifice. Incidentally, as a result of the experiment performed by the inventors, it was proved that the spray atomization effect was enhanced by tapering the upstream-side orifice and that the spray cone angle control effect was improved by tapering the downstream-side orifice, and particularly, the most excellent atomization characteristic and the most excellent spray cone angle control effect were obtained by the combination of the tapered first and second orifices.

In the plural embodiments described above, description has been made about the case that the orifice is formed in the silicon plate, and however, description will be given of another method of producing an orifice plate with reference to FIGS. 19A–E.

First, silicon nitride films 101*a*, 10l*b* are formed on both surfaces of a silicon plate 100 (STEP (1)), then, a back window pattern 102 is formed in the silicon nitride film on the back (STEP (2)), then, the silicon plate 100 is subjected to an anisotropic etching (STEP (3)), then, the silicon nitride films 101*a*, 101*b* are removed (STEP (4)), and then, a metallic thin film 103 is formed by evaporation on the surfaces of the silicon plate 100 (STEP (5)). By so doing, since the metallic thin film 103 is formed, the strength is increased.

Next, description will be given of still another method of producing an orifice plate with reference to FIGS. 20A–G. First, the silicon nitride films 101*a*, 101*b* are formed on the surfaces of the silicon plate 100 (STEP (1)), then, the back window pattern 102 is formed in the silicon nitride film 101*b* on the back of the silicon plate 100 (STEP (2)), then, the silicon plate 100 is subjected to the anisotropic etching (STEP (3)), and then, the silicon nitride films 101*a*, 101*b* are removed (STEP (4)). Using the silicon plate 100 thus obtained as a die, a molded body 105 is formed (STEP (5)), and a metallic film 106 is made using the molded body 105 as a die (STEP (6)), and then, the molded body 105 is removed (STEP (7)). In the orifice plate thus obtained as the metallic film 106, a hole portion 106*a* serves to form an orifice through which the fuel is passed.

In the case of forming the orifice plate by using the silicon plate, owing to the anisotropy of silicon, the inner wall of the orifice is so formed as to be tapered or divergent at a predetermined angle of inclination as viewed from the surface to the back of the orifice. The orifice plate according to the present invention can be formed as well by making use of metal instead of silicon. In such case, the angle of inclination of the inner wall of the orifice can be set am any angle in the absence of the anisotropy.

Incidentally, the above-described embodiments have been described about the case that the first and second plates are overlapped each other, and however, it is also possible in the present invention to overlap three or more plates.

Description will be given of an eleventh embodiment of the present invention with reference FIGS. 21A, 21B and 22.

Figure 21A:
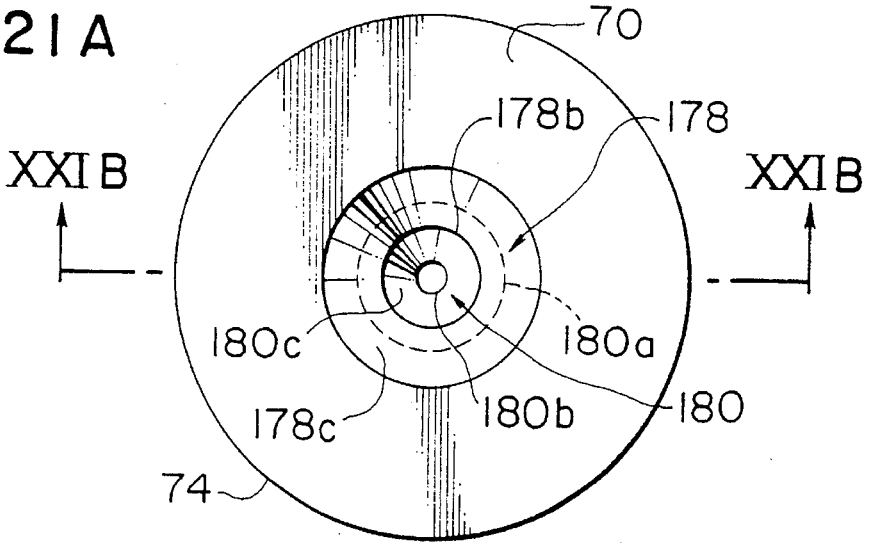
FIG. 21A is a plan view showing orifice plates according to an eleventh embodiment of the present invention.
Figure 21B:
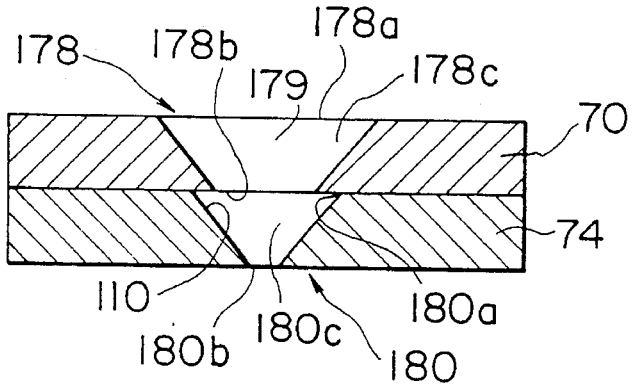
FIG. 21B is a sectional view taken along the line XXIB—XXIB of FIG. 21A.
Figure 22:
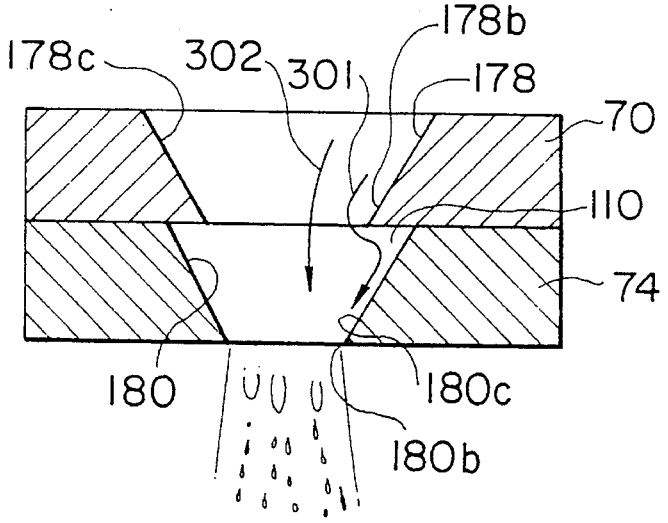
FIG. 22 is a schematic sectional view for explanation of the principle of atomization of the fuel spray according to the eleventh embodiment of the present invention.

As shown in FIGS. 21A and 21B, the first orifice plate 70 is formed in a central portion thereof with a conical first orifice 178. The first orifice 178 is so formed as to be tapered as going toward a lower second orifice plate 74 (the downstream side of the fuel flow)

The second orifice plate 74 is formed therein with a conical second orifice 180 which is coaxial with the first orifice 178, as shown in FIGS. 21A and 21B. The second orifice 18C is so formed as to be tapered as going downward similarly to the first orifice 178. It is possible to use stainless steel, resin, single-crystal silicon and the like as the material of the first and second orifice plates 70 and 74. And, as shown in FIGS. 21A and 21B, when attached to the valve main body 29, the first and second orifice plates 70 and 74 are overlapped each other so that the first and second orifices 178 and 180 are made to be coaxial with each other.

Accordingly, a fuel flow path 179 leading from an upstream-side opening 178*a* of the first orifice 178 to a downstream-side opening 180*b* of the second orifice 180 can be formed. The sectional area of the fuel flow path 179 is reduced gradually from the upstream-side by, in the first place, a conical wall surface 178*c* of the first orifice 178, and is once increased suddenly at the portion where the downstream-side opening 178*b* of the first orifice 178 communicates with the upstream-side opening 180*a* of the second orifice 180. And, the sectional area of the fuel flow path 179 is reduced again gradually by a wall surface 180*c* of the second orifice 180 until, at the downstream-side opening 180*b* of the second orifice 180, the fuel flow path communicates with an intake passage of an internal combustion engine which is an external low-pressure space. It is noted here that the downstream-side opening 178*b* of the first orifice 178 serves to form an upstream-side throttle. Immediately below the downstream-side opening 178*b* of the first orifice 178 is formed an annular space 110. The space 110 is required by reason that the fuel injected from the downstream-side opening 178*b* is made to flow along the conical wall surface 180*c* of the second orifice 180. Owing to this space 110, the fuel injected from the downstream-side opening 178*b* is caused to flow along the wall surface 180*c* toward downward and, moreover, converge to the downstream-side opening 180*b*.

Function of the eleventh embodiment will be described with reference to FIG. 22.

The fuel injected from the injection hole 31 is converged gradually in the course of passing through the first orifice 178 and, thereafter, flows into the second orifice 180 by which the fuel is converged again and then jetted out. It is noted here that part of the fuel flow converged gradually by the first orifice 178, or a flow 301 close to the wall surface 178 is expanded toward the annular space 110 opened outwardly of the downstream-side opening 178*b* immediately after passing therethrough so as to be made to flow along the wall surface 180*c* of the second orifice 180. On the other hand, another flow 302 of fuel flowing near the center of the first orifice 178 goes directly toward the downstream-side opening 180*b* of the second orifice 180. For this reason, in the vicinity of the downstream-side opening 180*b* of the second orifice 180, the flows 301 and 302 collide with each other so that the atomization of the fuel jetted out from the downstream-side opening 180*b* is promoted. Moreover, after passing through the downstream-side opening 180*b* of the second orifice 180, the fuel spray form becomes conical.

According to the eleventh embodiment, the orifices directly communicated with and opened to each other in the direction of fuel injection are provided in the middle thereof with the space opened radially outwardly and the flow of fuel passed through the space and another flow of fuel directly flowing down through the communication opening collide with each other to thereby generate a complicated flow, and accordingly, an excellent atomization effect can be obtained. Besides, it is possible to make a desired form of the orifice passage easily by overlapping two orifice plates each other.

Next, a twelfth embodiment in which the first and second orifice plates 70 and 74 used in the eleventh embodiment are replaced by other type of plates will be described with reference to FIGS. 23A and 23B.

Figure 23A:
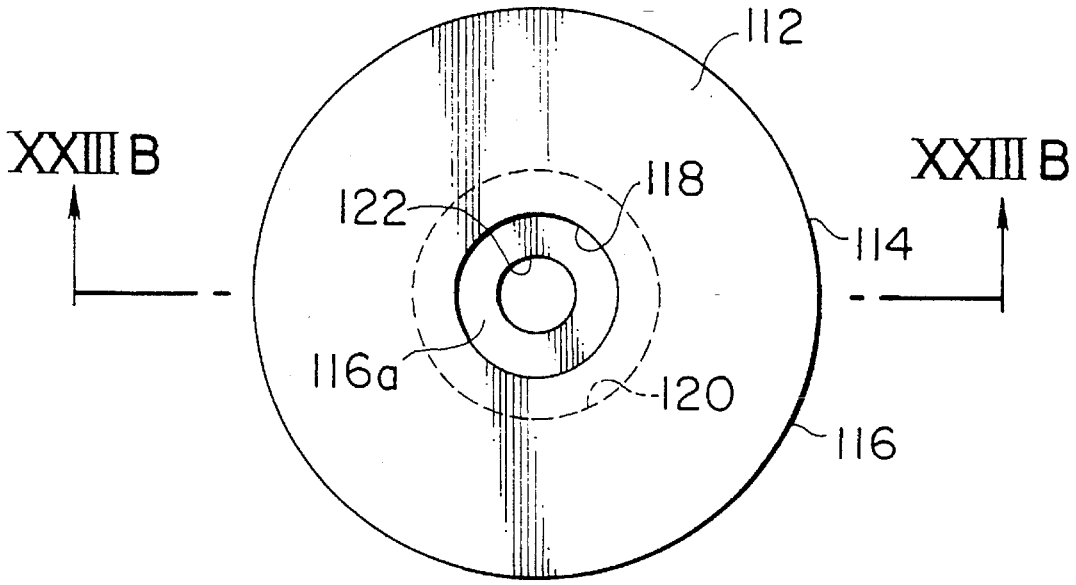
FIG. 23A is a plan view showing orifice plates according to a twelfth embodiment of the present invention.
Figure 23B:
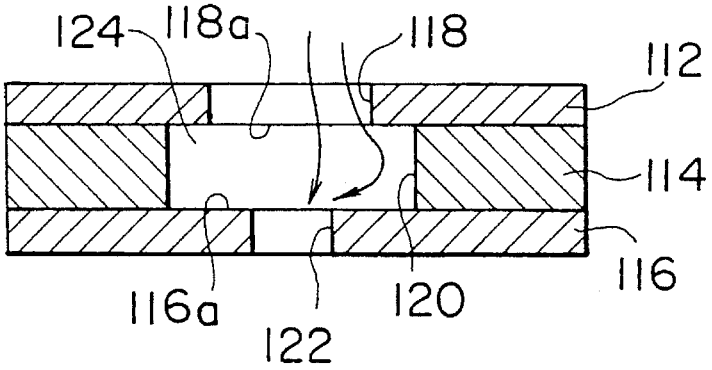
FIG. 23B is a sectional view taken along the line XXIIIB—XXIIIB of FIG. 23A.

The twelfth embodiment shown in FIGS. 23A and 23B comprises a first orifice plate 112 and second orifice plate 114 , 116. The first orifice plate 112 has a straightened first orifice 118 having a circular cross-sectional form.

The second orifice plate comprises two plates 114, 116 overlapped each other and has a large-diameter hole 120 formed in the upper plate 114 and a small-diameter hole 122 formed in the lower plate 116. The axes of the first orifice 118, the large-diameter hole 120 and the small-diameter hole 122 are aligned with each other. And, a large volume of space 124 is formed below an outlet 118*a*of the first orifice 118.

According to the twelfth embodiment, fuel is passed through the first orifice 118, the large-diameter hole 120 and the small-diameter hole 122 so as to be atomized. In this case, part of the fuel flowing through the first orifice 118 into the large-diameter hole 120 tends to pass through the small-diameter hole 122 straight, while another part thereof is spread and made to flow toward the space 124 and, further, made to flow along an upper surface 116*a* of the lower second plate 116 toward the small-diameter hole 122. And, in the vicinity of the small-diameter hole 122, the flow of fuel flowing down straight and another flow of fuel coming from the radial direction are made to collide with each other so that the fuel jetted out from the small-diameter hole 122 is atomized.

The fuel jetted out from the small-diameter hole 122 becomes conical in shape so as to be injected as a spray having a predetermined spray cone angle and a predetermined particle size. Further, such fuel spray can be formed easily without changing the ordinary fuel supply pressure.

Next, description will be given of a thirteenth embodiment of the present invention shown in FIGS. 24, 25 and 26.

Figure 24A:
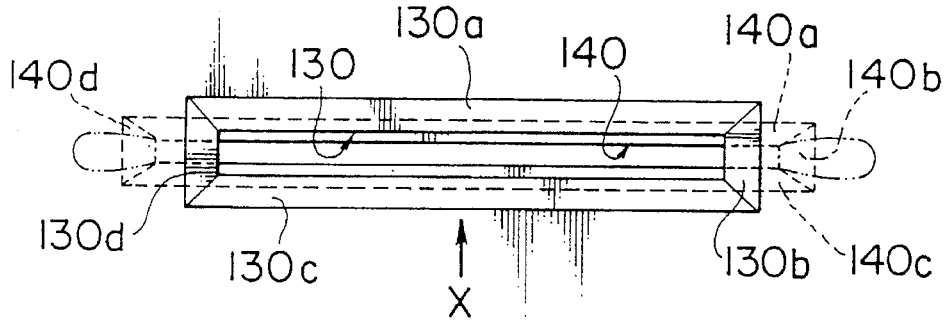
FIG. 24A is a plan view showing only the shape of orifices of orifice plates according to a thirteenth embodiment of the present invention.

In the thirteenth embodiment shown in FIG. 24A, a straight first orifice 130 is formed in the upper plate and a straight second orifice 140 is formed in the lower plate so as to be extended in the same direction as the first orifice 130 in which they are overlapped with each other. The first orifice 130 is formed by inner wall surfaces 130*a*, 130*b*, 130*c* and 130*d* and is tapered as going from top to bottom. The second orifice 140 is formed by inner wall surfaces 140*a*, 140*b*, 140*c* and 140*d* and is tapered as going from top to bottom. These straight orifices 130 and 140 are arranged in the same direction. And, the longitudinal length of the first orifice 130 is set to be shorter than that of the lower second orifice 140, while the width of the downstream-side opening of the first orifice 130 is set to be larger than that of the second orifice 140.

Figure 24B:
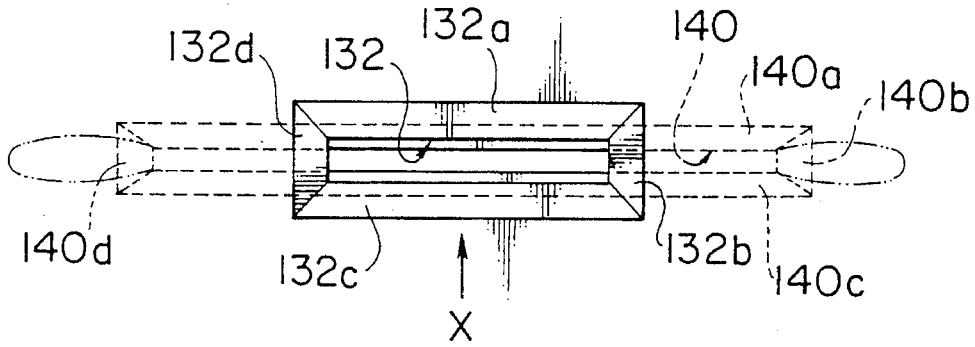
FIGS. 24B and 24C are plan views showing only the shape of orifices of orifice plates according to modifications of the thirteenth embodiment of the present invention, respectively.

In a modification of the thirteenth embodiment shown in FIG. 24B, the longitudinal length of a slit of a first orifice 132 formed in the upper plate is made shorter as compared with the case shown in FIG. 24A. The lower second orifice 140 is identical with that shown in FIG. 24A. The first orifice 132 is formed by inner wall surfaces 132*a*, 132*b*, 132*c* and 132*d*.

Figure 24C:
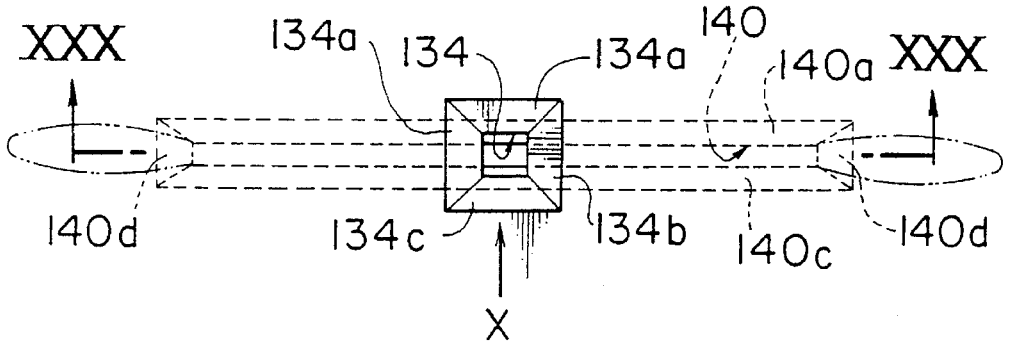
Figure 30:
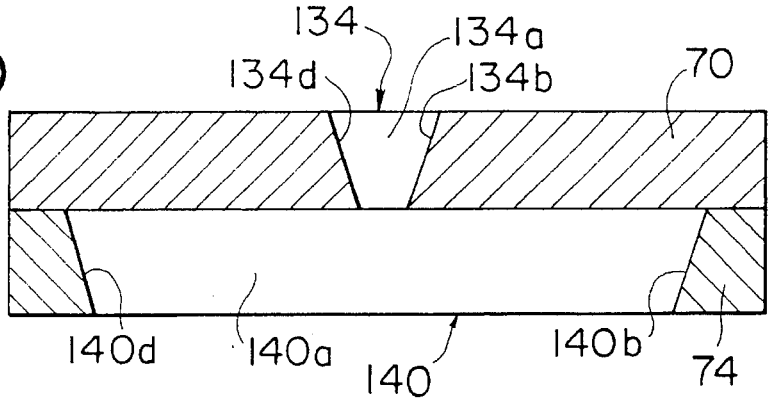
FIG. 30 is a sectional view of the orifice plates according to the modification of the thirteenth embodiment of the present invention, taken along the line XXX—XXX of FIG. 24C.

In another modification of the thirteenth embodiment shown in FIGS. 24C and 30, a first orifice 134 is used in place of the first orifice 130 described above. The first orifice 134 is further shortened in the longitudinal length of a slit thereof as compared with the first orifice 132 of the modification shown in FIG. 24B so that a square hole of the orifice the lengthwise and widthwise lengths of which are made equal to each other is formed by inner wall surfaces 134*a*, 134*b*, 134*c* and 134*d*. The second orifice 140 formed in the lower plate is identical with that shown in FIG. 24A.

Now, function of the thirteenth embodiment will be described using the orifice shape of FIG. 24C as an example, with reference to FIGS. 26A and 26B. In FIGS. 26, however, the square orifice 134 is shown as being a circular hole for the purpose of easy understanding.

Figure 26A:
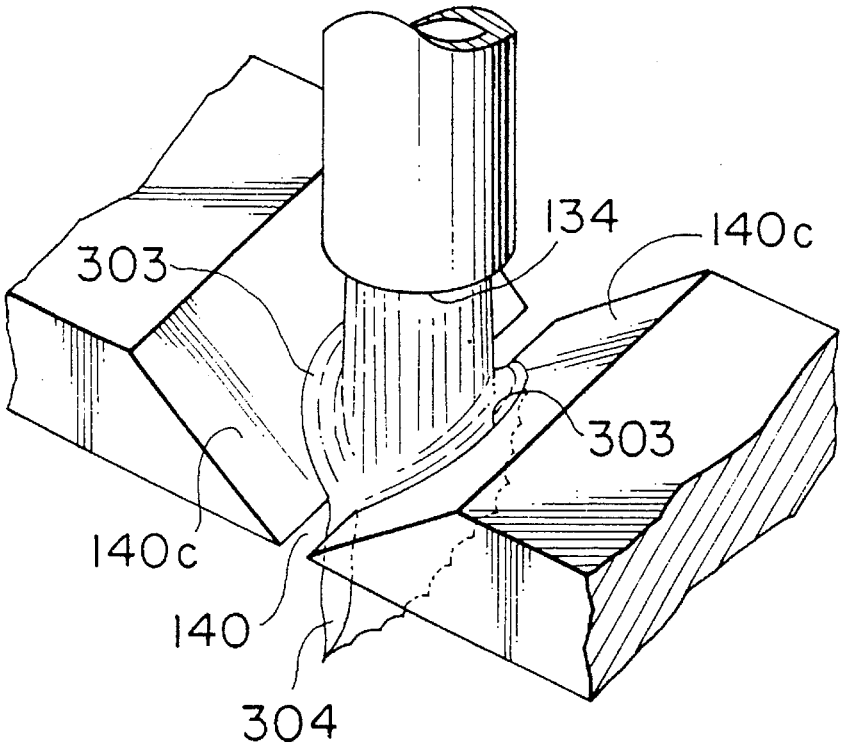
FIGS. 26A and 26B are a schematic perspective view and a plan view showing a state of formation of fuel liquid film with the use of the orifice plates according to the modification of the thirteenth embodiment of the present invention shown in FIG. 24C, respectively.
Figure 26B:
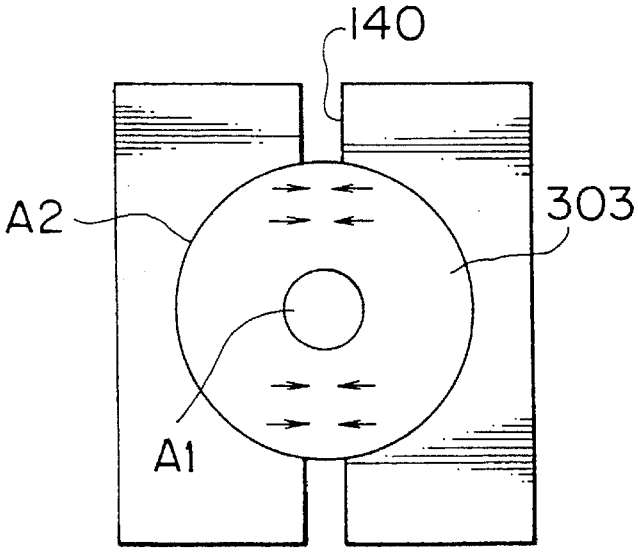

As shown in FIG. 26A, part of the fuel flowing out from the orifice outlet of the first orifice 134 tends to pass through the second orifice 140, while another part thereof forms fuel films 303 flowing down along the wall surfaces 140*a* and 140*c*. The flows along the wall surfaces attributable to the fuel films 303 are made to collide with each other as shown by arrow marks in FIG. 26B, and accordingly, a very thin liquid film 304 is formed immediately after the fuel is passed through the second orifice 140. Since this liquid film 304 tends to expand by diffusion, the liquid film becomes thinner and finally it forms an atomized fuel spray. Assuming that a cross-sectional area of fuel flow passed through the first orifice 134 is $A_1$ and a projected area of the fuel film is $A_2$, a relation $A_1 \leqq A_2$ is established.

Figure 25A:
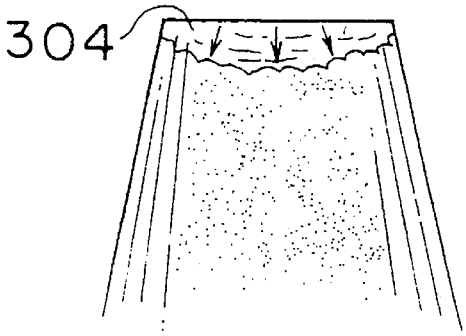
FIG. 25A is a schematic view showing a fuel spray form obtained by the orifice plates according to the thirteenth embodiment of the present invention shown in FIG. 24A.
Figure 25B:
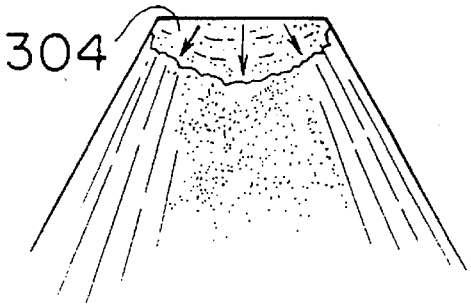
FIGS. 25B and 25C are schematic views showing fuel spray forms obtained by the modifications of the orifice plates according to the thirteenth embodiment of the present invention shown in FIGS. 24B and 24C, respectively.
Figure 25C:
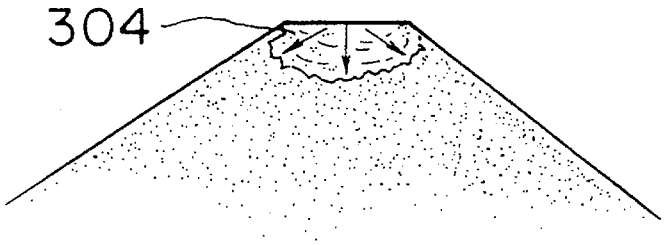

Next, description will be given of the fuel spray forms obtained by the thirteenth embodiment and the modifications thereof shown in FIGS. 24 with reference to FIGS. 25. FIGS. 25 show the spray forms as viewed from the direction of arrow mark X shown in FIGS. 24A, 24B and 24C. In the case of a spray form of the thirteenth embodiment shown in FIG. 24A, the spray cone angle is small and the density of fuel jetted out from both ends of the second orifice outlet is relatively high as shown in FIG. 25A. In FIGS. 25A, 25B and 25C, reference numeral 304 denotes a portion looked on as liquid film, and portions drawn by dot and line are the portions looked on as atomized mist. In the case of a fuel spray form according to the modification shown in FIG. 24B, the spray cone angle is a little larger as compared with the embodiment of FIG. 24A and the spray is distributed more uniformly in the longitudinal direction of the orifice as shown in FIG. 25B. In the case of a fuel spray form of the modification shown in FIG. 24C, the fuel spray cone angle is large and the spray is distributed relatively uniformly in the longitudinal direction of the orifice as shown in FIG. 25C. Further, in any of the cases shown in FIGS. 25A, 25B and 25C, the spray form is flat as viewed in the direction perpendicular to the paper surface.

These fuel spray forms may be set by varying suitably the shape of the orifices and the combination or overlapping thereof in accordance with various specifications of the internal combustion engine.

Next, description will be given of a fourteenth embodiment of the present invention and modifications thereof with reference to FIGS. 27A, 27B and 27C.

Figure 27A:
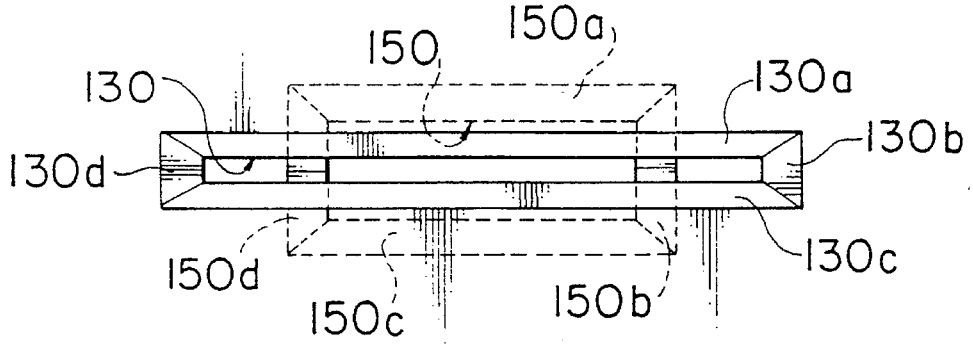
FIG. 27A is a plan view showing only the shape of orifices of orifice plates according to a fourteenth embodiment of the present invention.

In the fourteenth embodiment shown in FIG. 27A, the upper orifice 130 and a lower orifice 150 are overlapped each other in the same direction. The lower orifice 150 is formed by inner wall surfaces 150*a*, 150*b*, 150*c* and 150*d*. In this embodiment, the spray cone angle with respect to the longitudinal direction of the orifice is relatively small.

Figure 27B:
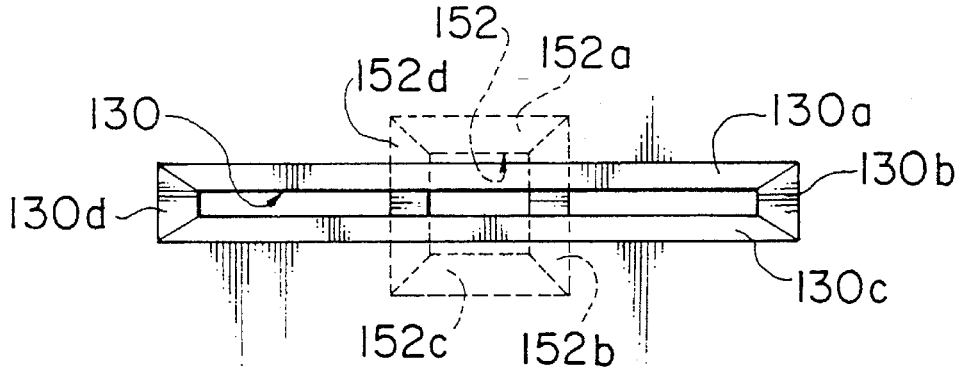
FIGS. 27B and 27C are plan views showing only the shape of orifices of orifice plates according to modifications of the fourteenth embodiment of the present invention, respectively.

In a modification of the fourteenth embodiment shown in FIG. 27B, the lower orifice is shortened in the longitudinal length as compared with that shown in FIG. 27A so as to form a lower orifice 152 of a square form. The orifice 152 is formed by inner wall surfaces 152*a*, 152*b*, 152*c* and 152*d*. In this modification, the spray cone angle takes an intermediate value between the spray cone angles obtained with the use of the orifice shown in FIGS. 27A and an orifice shown in FIG. 27C which is to be described later.

Figure 27C:
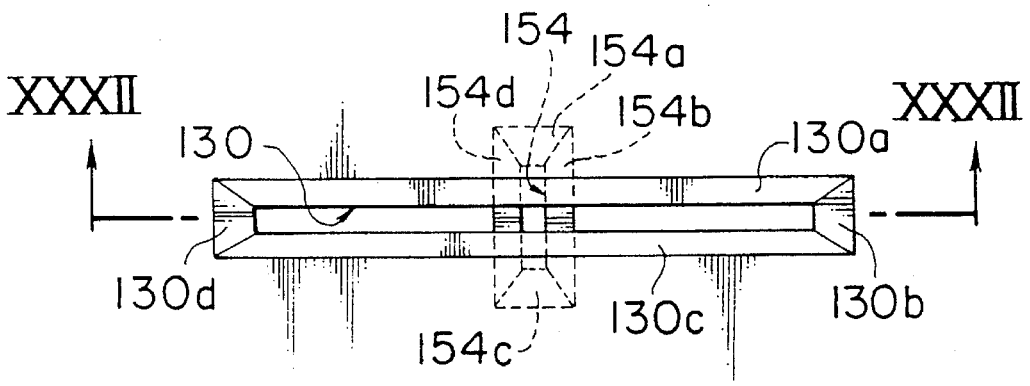
Figure 32:
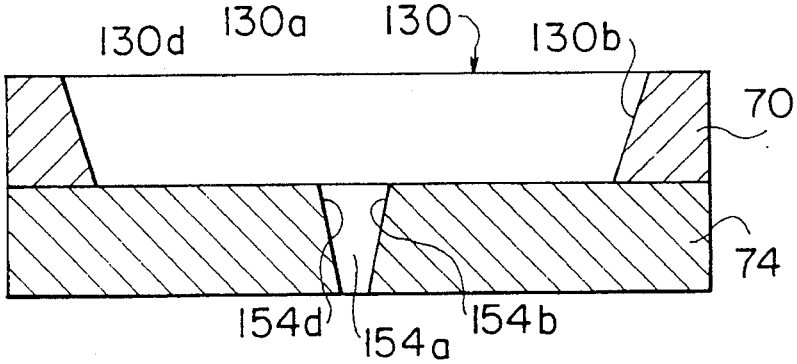
FIG. 32 is a sectional view of the orifice plates according to the modification of the fourteenth embodiment of the present invention, taken along the line XXXII—XXXII of FIG. 27C.

In another modification of the fourteenth embodiment shown in FIGS. 27C and 32, the length of the lower orifice 152 shown in FIG. 27B is further shortened in the longitudinal direction of the first orifice 130 so as to form a second orifice 154 which is longer in a direction perpendicular to the first orifice 130 and formed by inner wall surfaces 154*a*, 154*b*, 154*c* and 154*d*. In this modification, the fuel spray cone angle is further larger than that obtained by the orifice shown in FIG. 27B.

Next, a fifteenth embodiment of the present invention will be described with reference to FIGS. 28A and 28B.

Figure 28A:
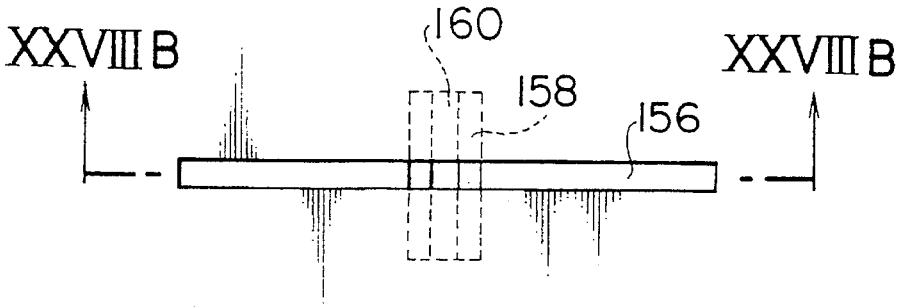
FIG. 28A is a plan view showing only the shape of orifices of orifice plates according to a fifteenth embodiment of the present invention.
Figure 28B:
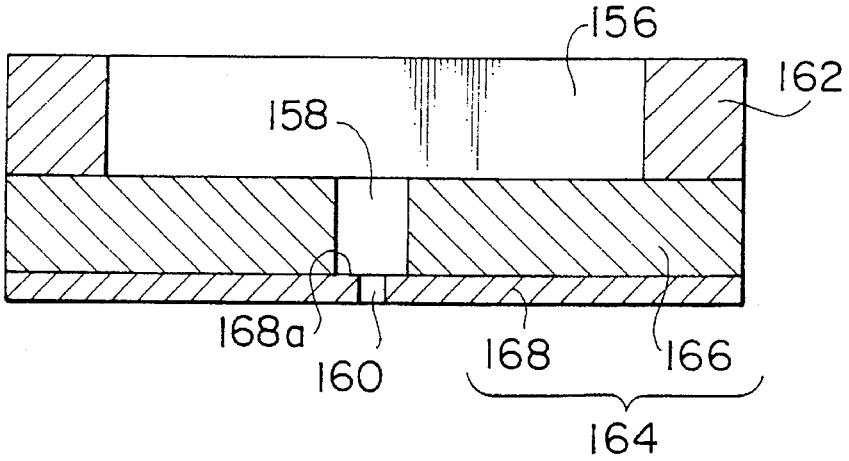
FIG. 28B is a sectional view taken along the line XXVIIIB—XXVIIIB of FIG. 28A.

The fifteenth embodiment shown in FIGS. 28A and 28B is a modification of the orifice shown in FIG. 27C. In this embodiment, in place of the first orifice 130 and the second orifice 154, a first orifice 156 and second orifice 158, 160 are formed, each orifice being straightened and having a uniform passage area in the direction of the flow of fuel. The straightened and slit-like first orifice 156 is formed in a first orifice plate 162. A second orifice plate 164 comprises two orifice plates 166 and 168. The second orifice comprises an upper straight orifice 158 formed in the upper orifice plate 166 and a lower straight orifice 160, the width of which is smaller than that of the orifice 158, formed in the lower orifice plate 168.

In the fifteenth embodiment described above, due to the orifices 158 and 160, the second orifice is so formed as to be tapered stepwise in the direction of the flow of fuel. In this embodiment as well, since the fuel film is formed on upper surface 168*a* of the orifice plate 168 likewise, the spray of fuel jetted out from the orifice 160 can be atomized in fine particles.

Next, a sixteenth embodiment of the present invention will be described with reference to FIGS. 29A and 29B.

Figure 29A:
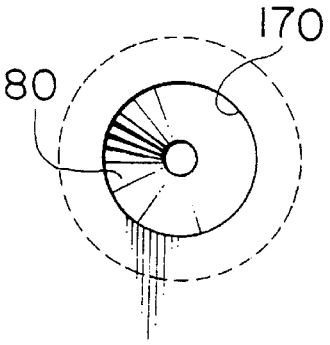
FIG. 29A is a plan view showing only the shape of orifices of orifice plates according to a sixteenth embodiment of the present invention.
Figure 29B:
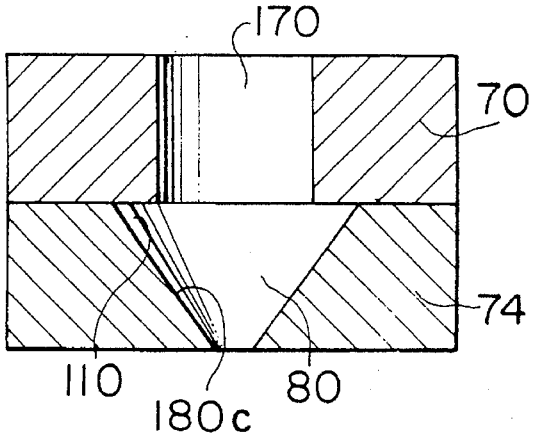
FIG. 29B is a sectional view of the orifice plates of the sixteenth embodiment of the present invention.

The sixteenth embodiment shown in FIGS. 29A and 29B is a modification of the eleventh embodiment shown in FIGS. 21A and 21B. In this embodiment, a straight or cylindrical orifice 170 is formed in the first orifice plate 70. Part of the fuel passed through the first orifice 170 is made to pass straight through the second orifice 80 of the second orifice plate 74, while another part off the fuel collides with the inner wall surface 180*c* so as to form a fuel film in the space 110. Owing to the collision of the flows of fuel flowing along the wall surface which have directional qualities resulting from the liquid film, atomization of the fuel can be improved.

A seventeenth embodiment of the present invention shown in FIG. 31 will be described.

Figure 31:
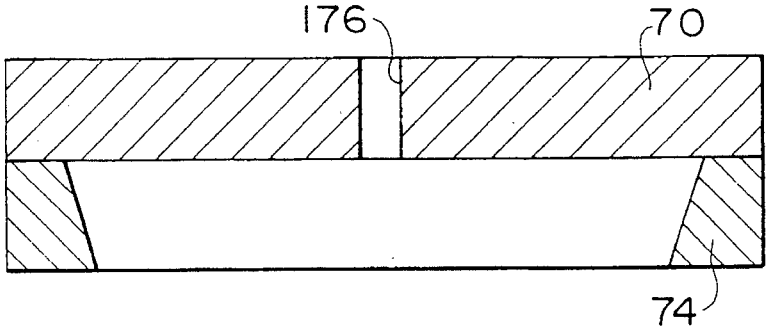
FIG. 31 is a sectional view of orifice plates according to a seventeenth embodiment of the present invention.

The seventeenth embodiment shown in FIG. 31 is a further modification of the modification of the thirteenth embodiment shown in FIG. 24C. Incidentally, for the purpose of comparison, a sectional view of the nozzle shown in FIG. 24C is shown in FIG. 30.

In the seventeenth embodiment shown in FIG. 31, in place of the first orifice 134, a cylindrical first orifice 176 is formed in the first orifice plate 70. Other portions are identical with those of the thirteenth embodiment shown in FIG. 30.

Next, description will be given of an eighteenth embodiment of the present invention with reference to FIG. 33.

Figure 33:
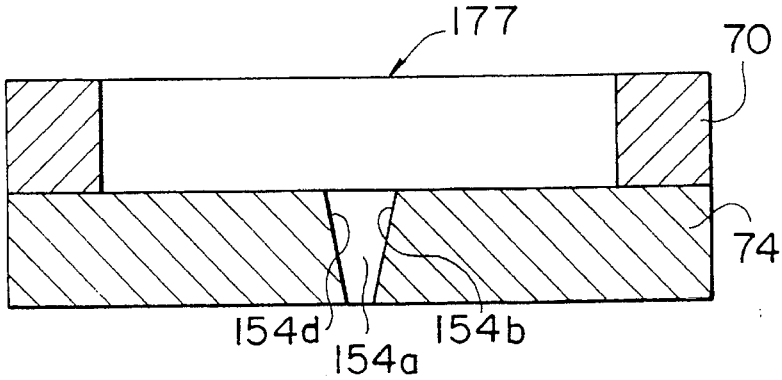
FIG. 33 is a sectional view of orifice plates according to a eighteenth embodiment of the present invention.

The eighteenth embodiment shown in FIG. 33 is a further modification of the modification of the fourteenth embodiment shown in FIG. 27C. Incidentally, for the purpose of comparison, a sectional view of the nozzle shown in FIG. 27C is shown in FIG. 32. In the eighteenth embodiment, in place of the upper tapered first orifice 130 shown in FIG. 32, a straightened first orifice 177 is formed.

In this embodiment as well, it is possible to improve the atomization of fuel likewise.

A nineteenth embodiment of the present invention will be described with reference to FIG. 34.

Figure 34:
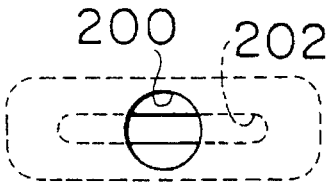
FIG. 34 is a schematic plan view showing the arrangement of orifices according to a nineteenth embodiment of the present invention.

In the nineteenth embodiment shown in FIG. 34, a circular first orifice 200 is formed in the upper orifice plate and a straight second orifice 202 is formed in the lower orifice plate. The centers of the first orifice 200 and the second orifice 202 are aligned with each other. The second orifice 202 is so formed as to be tapered as going downward. Moreover, the second orifice 202 is formed in the shape of a truncated pyramid with rounded comers so that concentration of fuel in the corner portions can be prevented.

Description will be given of a twentieth embodiment of the present invention with reference to FIGS. 35A and 35B.

Figure 35A:
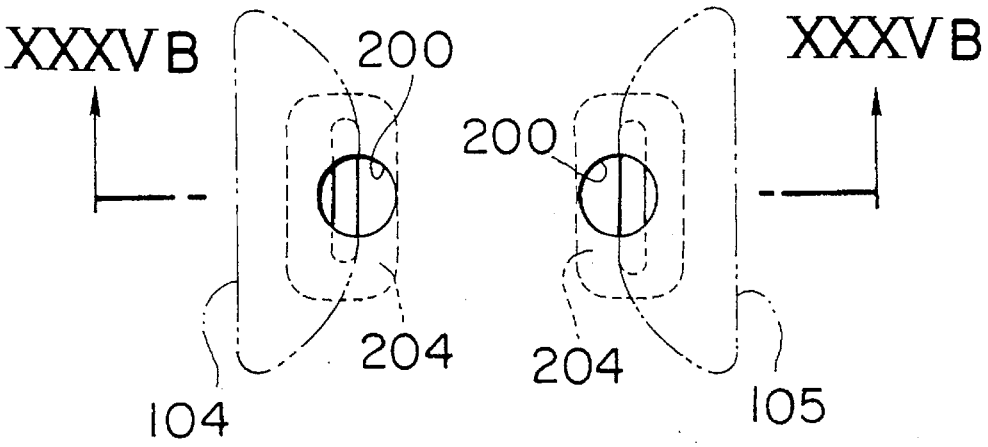
FIG. 35A is a schematic plan view showing the arrangement of orifices according to a twentieth embodiment of the present invention.
Figure 35B:
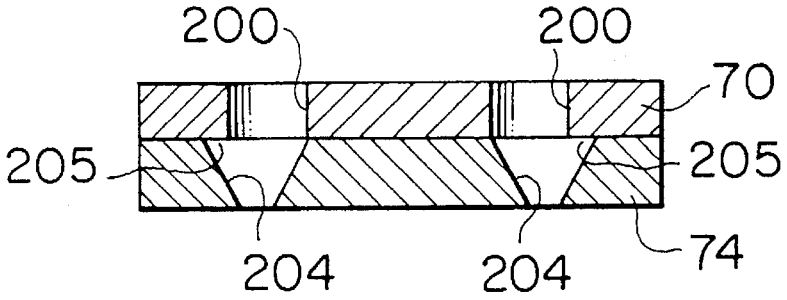
FIG. 35B is a sectional view taken along the line XXXVB—XXXVB of FIG. 35A.

In the twentieth embodiment shown in FIGS. 35A and 35B, the circular and straightened first orifices are formed in the upper orifice plate and tapered second orifices 204 are formed in the lower orifice plate. Since the centers of the first orifice 200 and the second orifice 204 are offset from each other, part of the fuel passed through the first orifice 200 is caused to collide with the inner wall surface of the second orifice 204, and accordingly, a fuel liquid film which is asymmetric with respect to the axis is formed on the inner wall surface of the second orifice 204, with the result that the atomization of fuel can be improved and such spray form is obtained that expands outwardly from the axis. In FIG. 35A, sprays in two directions are designated by reference numerals 104 and 105.

A twenty-first embodiment of the present invention will be described with reference to FIG. 36.

Figure 36:
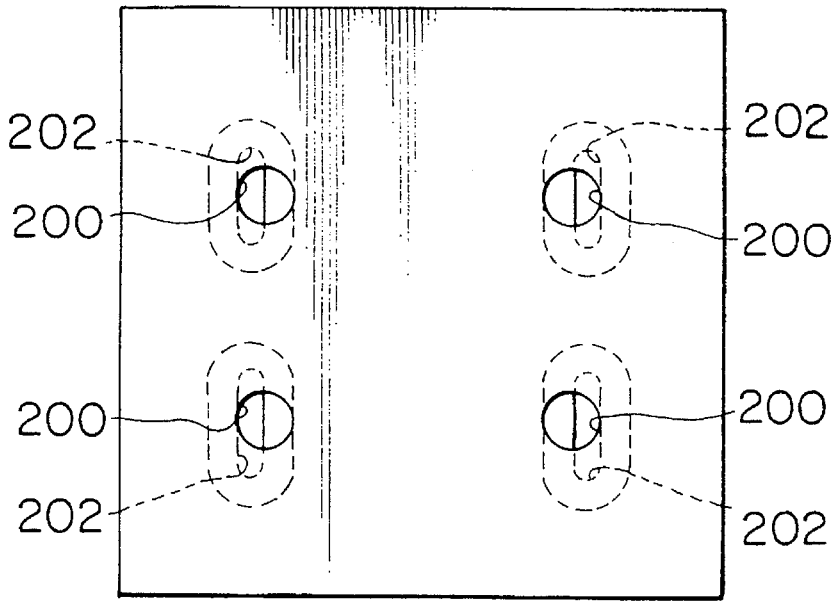
FIG. 36 is a schematic plan view showing the arrangement of orifices according to a twenty-first embodiment of the present invention.

In the twenty-first embodiment shown in FIG. 36, four sets of the first and second orifices 200 and 204 of the twentieth embodiment shown in FIGS. 35A and 35B are formed. These sets of orifices are arranged two by two so as to be in parallel with each other.

Description will be given of a twenty-second embodiment of the present invention with reference to FIG. 37.

Figure 37:
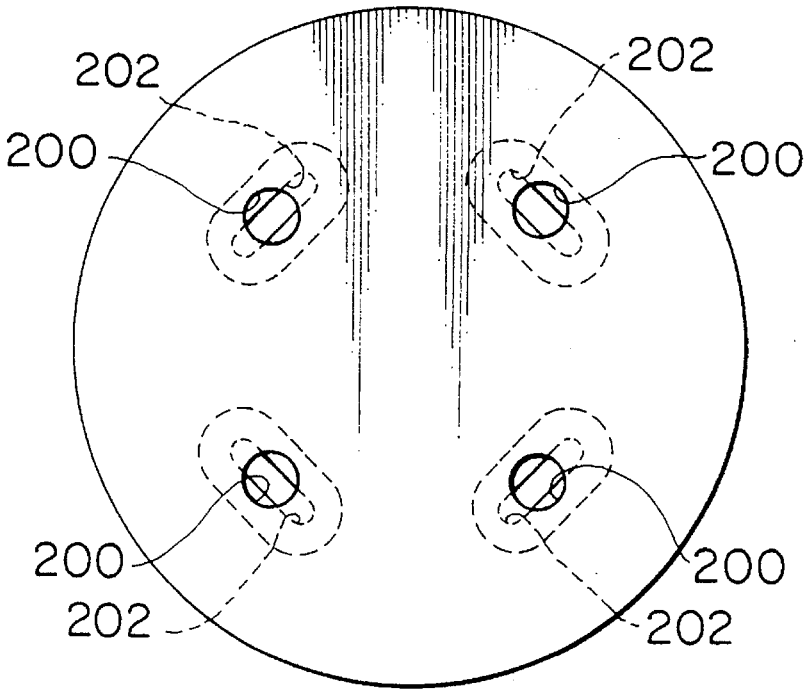
FIG. 37 is a schematic plan view showing the arrangement of orifices according to a twenty-second embodiment of the present invention.

In the twenty-second embodiment shown in FIG. 37, four first orifices 200 and four second orifices 202 are so formed as to be arranged in the shape of a square. In these twenty-first and twenty-second embodiments as well, the atomization of fuel can be promoted due to the function of forming the fuel film similarly to the space 202 shown in FIG. 35.

In the case of forming the orifice plate using the silicon plate, owing to the anisotropy of silicon, the inner wall of the orifice is inclined at a predetermined angle so that the orifice is tapered or divergent from the surface to the back of the orifice. The orifice plate according to the present invention can be formed as well by making use of metal in place of silicon. In such case, the angle of inclination of the inner wall of the orifice can be set at any angle in the absence of the anisotropy.

Incidentally, the above embodiments have been described about the case that the first and second plates are overlapped each other, and however, it is also possible in the present invention to overlap three or more plates.

In the plural embodiments described above, the plate in which the injection hole is formed by four faces is a silicon plate or a metallic plate such as of iron or stainless steel formed by using the silicon plate as a die. Incidentally, the four faces are produced in etching attributable to the anisotropy of silicon. Further, it is desired to form a protective film such as nitride film on the silicon plate.

On the other hand, the plate in which the injection hole having a circular shape or the like is formed is a metallic plate such as of iron or stainless steel. Such injection hole can be formed by means of electrical discharge machining or simple press work. Moreover, by adopting such metallic plate, it is possible to prevent crack resulting from the brittleness of the silicon plate. Furthermore, in the case of machining the metallic plate, there is no limitation on the wall surface shape resulting from the anisotropy, and accordingly, it is possible to set the angle of inclination of the wall surface freely.

Besides, in the embodiments described above, the slit-like hole has been described as extending only in a straight line, and however, any of slit holes extending in various forms is available. For instance, the penetrating opening may be formed in a portion of a slit hole extending in a curved line. Further, the penetrating opening may be formed substantially at the center of a slit hole extending in a spiral line so as to further improve the atomization and stabilize the injecting direction by making use of a vortex flow coming from the spirally extending groove toward the penetrating opening. Moreover, a central slit portion of a slit hole bent in a crank shape may be used as the penetrating opening.

In addition, in the embodiments described above, the injection hole constituting member is formed by overlapping the completely independent plates, and however, it is also possible to overlap such member that has a plate portion only in a portion thereof. For example, a cup-shaped member may be formed in the bottom thereof with a hole.

Furthermore, three or more plates may be overlapped in the present invention.

What is claimed is:

1. A fluid injection nozzle serving to form an injection hole through which pressurized fluid is injected toward a low-pressure space, said nozzle comprising:

a first plate having a first hole of a predetermined form; and a second plate having a second hole of a predetermined form, wherein said first and second plates are overlapped with each other and said two holes are so located as to be overlapped with each other to form a penetrating opening which penetrates through directly in a direction of fluid injection, so that fluid is injected through said two holes, said first plate and said second plate each having an upstream-side and a down-stream side such that the downstream-side of said first plate is adjacent the upstream-side of said second plate, an area of overlap of the first hole of said first plate and the second hole of said second plate being smaller than an upstream-side area of the second hole of said second plate such that said first hole defines a first throttle portion and said upstream-side area of the second hole defines an expanded fluid path portion, said second hole further defining a second throttle portion at the downstream-side of the second plate.

2. A fluid injection nozzle according to claim 1, wherein a cross-sectional area of the second hole of said second plate gets smaller gradually from upstream side to downstream side.

3. A fluid injection nozzle according to claim 2, wherein said second hole of said second plate is defined by a first pair of inclined surfaces facing each other and a second pair of inclined surfaces facing each other and wherein an axial cross-sectional area of said second hole of said second plate gradually decreases from said upstream-side of said second plate to said downstream-side thereof.

4. A fluid injection nozzle according to claim 3, wherein said first pair of inclined surfaces are connected smoothly with said second pair of inclined surfaces so as to form a continuous wall surface.

5. A fluid injection nozzle according to claim 1, wherein said second plate comprises a third plate which is formed therein with an intermediate hole having a predetermined opening area and a fourth plate which is formed therein with a downstream hole having a smaller opening area than said intermediate hole and underlying said third plate, and a cross-sectional area of said second hole is reduced stepwise by said intermediate hole and said downstream hole.

6. A fluid injection nozzle according to claim 1, wherein said first hole of said first plate is formed in a slit-like shape, a downstream-side opening of said first hole is partially communicated with said second hole of said second plate as a communication opening, and the other portion of said downstream-side opening of said first hole is closed by an upper surface of said second plate so as to form a groove extending from said communication opening.

7. A fluid injection nozzle according to claim 6, wherein an upstream-side opening of said second hole of said second plate is larger than said communication opening with respect to a direction crossing a longitudinal direction of said slit-like first hole of said first plate.

8. A fluid injection nozzle according to claim 7, wherein said second hole of said second plate is a slit-like hole which crosses the slit-like first hole of said first plate.

9. A fluid injection nozzle according to claim 8, wherein the cross-sectional area of said first hole of said first plate gets smaller gradually from upstream side to downstream side.

10. A fluid injection nozzle according to claim 1, wherein a cross-sectional area of said first hole of said first plate gets smaller from upstream side to downstream side.

11. A fluid injection nozzle according to claim 10, wherein said first hole of said first plate is formed in a slit-like shape, a downstream-side opening of said first hole is partiality communicated with said second hole of said second plate as a communication opening, and the other portion of said downstream-side opening of said first hole is closed by an upper surface of said second plate so as to form a groove extending from said communication opening.

12. A fluid injection nozzle according to claim 10, wherein said first hole of said first plate is formed in a circular shape.

13. A fluid injection nozzle according to claim 1, wherein said first hole of said first plate is made larger in cross-sectional area thereof as going toward an interface between said first plate and said second plate, and said second hole of said second plate is so formed as to have a minimum cross-sectional area which is smaller than a cross-sectional area of said first hole at said interface and forms a space which is larger than said penetrating opening in the radial direction at said interface.

14. A fluid injection nozzle according to claim 1, wherein at least one of said first and second holes of said first and second plates is formed in a slit-like shape.

15. A fluid injection nozzle according to Claim 14, wherein said slit-like hole is overlapped and partially communicated with the hole of the other plate, while the other portion thereof serves to form a groove the bottom of which is formed by the surface of the other plate.

16. A fluid injection nozzle according to claim 15, wherein at least one of said first and second holes of said first and second plates gets smaller gradually in a cross-sectional area thereof from upstream side to downstream side

17. A fluid injection nozzle according to claim 16, wherein both of said first and second holes of said first and second plates are formed in the slit-like shape, and said first hole of said first plate and said second hole of said second plate cross each other.

18. A fluid injection nozzle according to claim 17, wherein said first hole of said first plate has a plurality of slit-like portions, and said second hole of said second plate has a plurality of slit-like portions which are overlapped with the slit-like portions of said first hole of said first plate.

19. A fluid injection nozzle according to claim 16, wherein said first hole of said first plate is formed in the shape of a slit, and said second hole of said second plate has a cross-sectional form of which the lengthwise and widthwise lengths; are substantially equal to each other.

20. A fluid injection nozzle according to claim 19, wherein said second hole of said second plate is formed in a circular shape.

21. A fluid injection nozzle according to claim 19, wherein said second hole of said second plate is formed in a square shape.

22. A fluid injection nozzle according to claim 19, wherein said first hole of said first plate has a plurality of slit-like portions, and said second hole of said second plate has a plurality of slit-like portions which are overlapped with the slit-like portions of said first hole of said first plate, 23. A fluid injection nozzle according to claim 16, wherein said first hole of said first plate is formed in the shape of a slit, and said second hole of said second plate is formed in the shape of a slit which is longer than that of said second hole of said first plate, and said first hole of said first plate and said second hole of said second plate are arranged in parallel with each other.

24. A fluid injection nozzle according to claim 1, wherein said fluid injection nozzle is combined with a valve and disposed on the downstream side of said valve so as to serve to inject the fluid passed through said valve.

25. A fluid injection nozzle according to claim 24, wherein said valve is a fuel injection valve that intermits the injection of fuel to be supplied to an internal combustion engine.

26. An injection hole constituting member which serves to form a fuel injection hole of a fuel injection valve that injects pressurized fuel as a spray which is combustible in an internal combustion engine, said injection hole constituting member comprising:

a first member having a plate portion in which a first hole having a predetermined shape is formed; and a second member disposed on the downstream-side of said first member in close contact with the plate portion of said first member and having a plate portion in which a second hole is so formed as to be located on the downstream side of said first hole to form a penetrating opening which penetrates directly from said first hole in the direction of fluid injection, wherein an axial cross-sectional area of said second hole of said second member gradually decreases from an upstream-side thereof to a downstream-side thereof and an area of said penetrating opening is smaller than an upstream-side area of said second hole of said second member.

27. An injection hole constituting member according to claim 26, wherein at least one of said first and second holes is opened in the shape of a slit.

28. An injection hole constituting member according to claim 26, wherein said first hole is opened in the shape of a slit.

29. An injection hole constituting member according to claim 28, wherein said second hole is opened in a shape of a slit which crosses the longitudinal direction of said first hole.

30. An injection hole constituting member according to claim 26, wherein at least one of said first and second holes is opened in a shape in which the lengthwise and widthwise lengths are substantially equal to each other.

31. An injection hole constituting member according to claim 26, wherein said second member is formed by stacking an upstream-side third plate and a downstream-side fourth plate in layers, and said third plate is formed therein with a large-diameter hole while said fourth plate is formed therein with a small-diameter hole so that the cross-sectional area gets smaller stepwise from upstream side to downstream side.

32. An injection hole constituting member which serves to form a fuel injection hole of a fuel injection valve that injects pressurized fuel as a spray which is combustible in an internal combustion engine, said injection hole constituting member comprising:

a first member having a plate portion in which a first hole extending like a slit over a predetermined length is formed; and a second member disposed on the downstream-side of said first member in close contact with the plate portion of said first member and having a plate portion in which a second hole is formed, said second hole being in flow communication with only a portion of said first hole, said plate portion of said second member closing a remaining portion of said first hole, an axial cross-sectional area of said second hole of said second member gradually decreasing from an upstream-side thereof to a downstream-side thereof and an area of said flow communication being smaller than an upstream-side area of said second hole of said second member.

33. An injection hole constituting member according to claim 32, wherein said first hole gradually decreases in cross-sectional area from an upstream-side thereof to a downstream-side thereof.

34. An injection hole constituting member according to claim 33, wherein both of said first and second holes are formed in the slit-like shape, and said first hole and said second hole are made to cross each other.

35. An injection hole constituting member according to claim 34, wherein said first hole has a plurality of slit-like portions, and said second hole has a plurality of slit-like portions which are overlapped with the slit-like portions of said first hole.

36. An injection hole constituting-member according to claim 32, wherein said second hole has a cross-sectional form in which the lengthwise and widthwise lengths are substantially equal to each other.

37. An injection hole constituting member according to claim 36, wherein said first hole has a plurality of slit-like portions while said second hole has a plurality of holes which are overlapped with the slit-like portions of said first hole.

* * * * *